US007942726B2

(12) United States Patent
Ling

(10) Patent No.: US 7,942,726 B2
(45) Date of Patent: May 17, 2011

(54) HOLDER FOR SUPPORTING AN END SURFACE OF A WORKPIECE DURING POLISHING

(76) Inventor: Kow-Je Ling, Taipei (TW)

( * ) Notice: Subject to any disclaimer, the term of this patent is extended or adjusted under 35 U.S.C. 154(b) by 904 days.

(21) Appl. No.: 11/812,967

(22) Filed: Jun. 22, 2007

(65) Prior Publication Data

US 2008/0113593 A1 May 15, 2008

(30) Foreign Application Priority Data

Jun. 29, 2006 (TW) ..... 95123532 A

(51) Int. Cl.
*B24B 7/00* (2006.01)

(52) U.S. Cl. ..... 451/271; 451/278; 451/384; 451/390

(58) Field of Classification Search ..... 451/41, 451/57, 256, 270, 271, 278, 283, 285, 384, 451/390

See application file for complete search history.

(56) References Cited

U.S. PATENT DOCUMENTS

| | | | | | |
|---|---|---|---|---|---|
| 5,038,524 | A | * | 8/1991 | Moulin | 451/548 |
| 5,216,846 | A | * | 6/1993 | Takahashi | 451/57 |
| 5,351,445 | A | * | 10/1994 | Takahashi | 451/271 |
| 5,547,418 | A | * | 8/1996 | Takahashi | 451/278 |
| 6,039,630 | A | * | 3/2000 | Chandler et al. | 451/6 |
| 6,077,154 | A | * | 6/2000 | Takashi et al. | 451/271 |

FOREIGN PATENT DOCUMENTS

| | | | |
|---|---|---|---|
| CN | 1752777 | A | 3/2006 |
| JP | 5157941 | A | 6/1993 |

* cited by examiner

*Primary Examiner* — Eileen P. Morgan

(57) ABSTRACT

A holder for supporting an end surface of a workpiece during polishing comprises a main body and a framework which are respectively provided with fixing portions corresponding to each other; at least one of the two fixing portions has at least one set of upper and lower contact portions, and the upper and the lower contact portions on each set are respectively disposed above and below a contact plane formed between the end surface of the workpiece and a polishing surface; when the upper and lower contact portions and another one of the fixing portions one another, the main body is capable of keeping parallel to the polishing surface, and the pressure acting on the end surface of each workpiece is capable of being approximately uniform. Hence, the number of end surfaces of the optical fibers can be increased tremendously during polishing so as to enhance the polishing speed and quality.

38 Claims, 23 Drawing Sheets

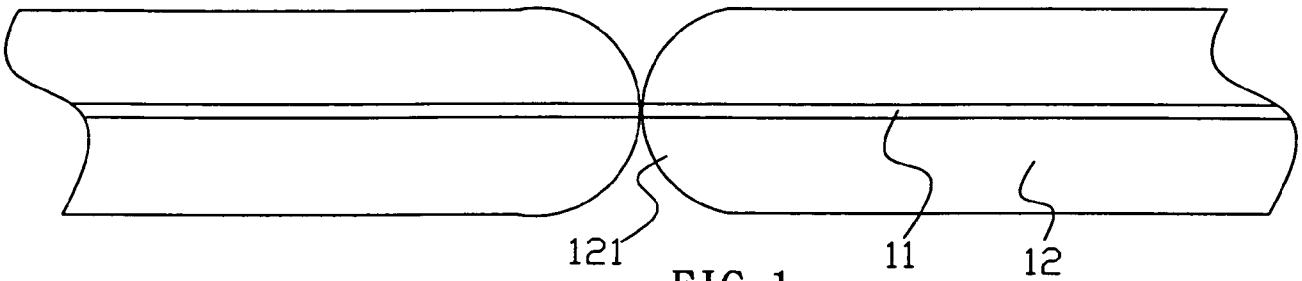
FIG. 1
(PRIOR ART)
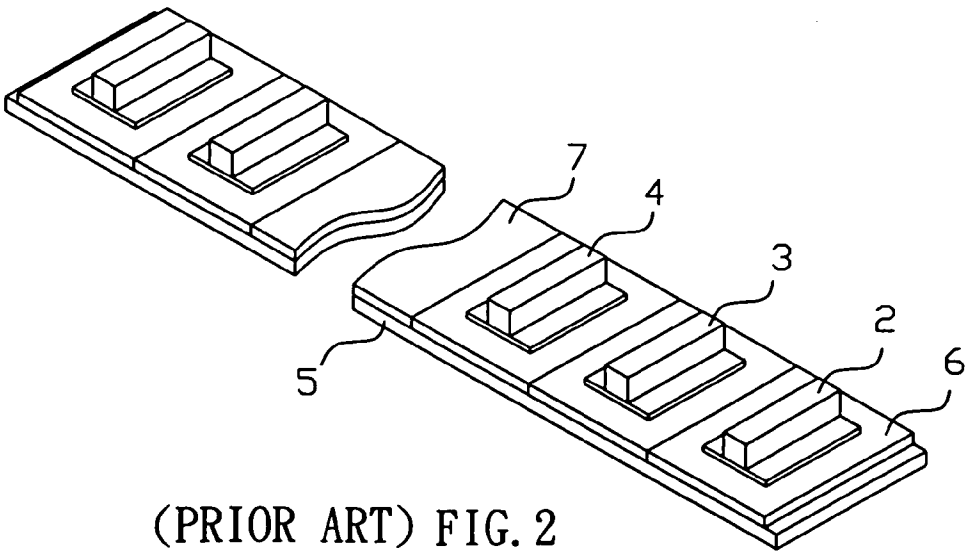
(PRIOR ART) FIG. 2

HOLDER FOR SUPPORTING AN END SURFACE OF A WORKPIECE DURING POLISHING

BACKGROUND OF THE INVENTION

1. Field of the Invention

The present invention relates to an apparatus for polishing an end surface of a workpiece, and more particularly, to a holder for supporting an end surface of an optical fiber during a polishing being performed.

2. Description of Related Art

The optical fiber communication has been an indispensable communication tool at present and it will be in the future too. The main structure of an optical fiber connecter used for the optical fiber communication, as FIG. 1 shows, is constituted by an optical fiber 11 passing through a ferrule 12 and then being adhered to the ferrule 12 with an adhesive. The ferrule 12 can be made from plastic, glass or ceramics. A projecting spherical surface 121 of the end surface of the ferrule 12 is pressed by an elastic polishing surface and formed by way of coarse grinding, fine grinding and polishing respectively. The finished projecting spherical surface 121 must be worked as a flawless curved surface. An optical axis of the projecting spherical surface 121 can either be parallel to a central line of the optical fiber 11 or incline a small angle with the central line.

A conventional method for polishing the end surface of an optical fiber is to keep the end surface stationary, and to rotate and revolve the polishing surface in the process of polishing the end surface. It can be known from a mathematical analysis disclosed in Taiwan Patent No. 485863 entitled as "Polishing apparatus for optical fiber end surface". If the movement way of the polishing surface is rotation plus revolution, the end surface of the optical fiber is merely arranged on the circumference of the holder. If there is only revolution without rotation, the wearing degree of every spot on the end surface is the same. The end surfaces of multiple optical fibers can be arranged on the entire holder evenly. Besides, the patent mentioned above also discloses that if the polishing surface is fabricated to have a shape of strip, one side of the polishing surface is provided with coarse polishing particles and another side of the polishing surface is provided with fine polishing particles. FIG. 2 shows that several holders 2, 3 and 4 are on a strip polishing surface 5 in which the right side 6 of the polishing surface 5 is provided with the coarse polishing particles, and the left side 7 of the polishing surface is provided with the fine polishing particles. The pressure between the end surface of the respective optical fiber on the holders and the polishing surface 5 can be uniform if a proper arrangement is performed. Hence, the holders 2, 3 and 4 are slid on the polishing surface 5 from the side with the coarse polishing particles toward the side with the fine polishing particles, and, in the mean time, the end surface of the respective optical fiber can be finished with the process of coarse grinding, fine grinding, and polishing sequentially. Thus, if the problem regarding uniform pressure between the end surface of the respective optical fiber and the polishing surface is solved, theoretically, end surfaces of a great number of optical fibers can be polished simultaneously.

Basically, an uneven pressure is arisen from the following reasons:

1. The supporting point of the holder is not on a plane of application of force which is generated from a friction between the end surface of an optical fiber and the polishing surface so that a torque is yielded to slant the holder so as to produce the uneven pressure;

2. The polishing surface not parallel to the holder may yield the uneven pressure too if the holder is fixedly clipped.

Please refer to FIGS. 3 and 4. A conventional polishing apparatus for the end surface of an optical fiber comprises a polishing surface 21, a ferrule 22, a holder 23 and a pressing rod 24. An end surface 251, 252 of the respective optical fiber 25 is attached to the ferrule 22. When there is a relative movement between the end surface of the optical fiber 25 and the polishing surface 21, the holder 23 is subject to a transverse force at an end face thereof. But, the supporting point is at one of contact points 31, 32 right at this time such that the holder 23 is subject to a counterclockwise torque. As a result, the holder 23 becomes slanting as shown in FIG. 4 to cause the end surface 251 to be lower than the end surface 252, i.e., it causes the pressure acting on the end surface 251 is greater than on the end surface 252.

For solving the aforementioned problem, U.S. Pat. No. 5,216,846 discloses a spacer for maintaining a constant distance between the workpiece and the polishing surface. Because the polishing surface is elastic, maintaining the constant distance means maintaining a uniform pressure. In such manner, part of the uneven pressure is borne by the spacer to overcome the preceding problem to some extent, but, the torque is still there because the original structure is kept without change such that the unfavorable factor resulting in the uneven pressure is still there. Moreover, U.S. Pat. No. 6,039,630 discloses that a pressure sensor is utilized to measure the pressure instantly and compensate the unevenness of pressure by means of a method with an electronically controlled spring.

Furthermore, U.S. Pat. No. 6,077,154 and U.S. Pat. No. 5,351,445 respectively teach a design for clipping and fixing an end surface of an optical fiber as shown in FIG. 5 in which a holder 41 is combined with a plurality of optical fiber fixtures 42 for clipping optical fibers 43 respectively. The holder 41 is fixed by the fixtures 42 on the upper side of the polishing surface 45. Because the holder 41 is clipped and fixed, the problem of slanting arisen from the torque basically dose not happen. But, there is still another problem which has to be solved; because the holder 41 is clipped and fixed, and the direction which the polishing surface 45 faces to is also fixed, the holder 41 and the polishing surface 45 are not able to be accurately parallel to each other. In order to overcome the deficiency, the common practice is to adjust the fixtures 42 angularly for fixing the holder 41. But, this way is forcible and not a natural contact such that the holder 41 always is a little unparallel to the polishing surface 45. Besides, the pressure between the end surface of the optical fiber 43 and the polishing surface 45 is produced by a force exerting upwards from the bottom, and it is not only too complicated but also not suitable for automation. Furthermore, if the polishing surface is strip as shown in FIG. 2 for being slid with several holders simultaneously, it is then difficult for the end surface on each holder to keep the uniform pressure.

Furthermore, Taiwan Patent No. 222915 entitled as "Polishing Holder for optical fiber end surface", which is granted to the present inventor, discloses two following principles for obtaining uniform pressure:

1. The holder shouldn't be clipped and fixed, and must naturally contact with the polishing surface. That is, the holder oscillates up and down with the polishing surface when the polishing surface oscillates up and down, and the average pressure of the end surface on the holder keeps uniform when the holder oscillates up and down.
2. A plane formed by the end surface in the process of polishing is a plane of application of force that is a plane constituted with a force exerted to the holder by the polishing surface. It is necessary to provide one or several supporting points for the holder because, in principle, the holder does not move or rotate with the polishing surface in the process of polishing. In order to obtain the uniform pressure, these supporting points must be on the plane of application of force to keep the holder from moving or rotating with the polishing surface.

Please refer to FIGS. 6A and 6B. A holder designed with the two principles comprises a main body 50 having a fixing groove 51 at the lower side of the center thereof for accepting a fixing rod 52. A plurality of symmetrical accepting grooves 53 are respectively disposed close to the periphery of the main body 50. The accepting grooves 53 can be curved grooves, cylindrical grooves or elongated grooves. The main body 50 can be circular-shaped or square-shaped. The main body 50 is combined with a plurality of fixtures 500. Each fixture 500 is joined to at least one ferrule 55 for holding an optical fiber 56. A polishing surface 57 is disposed beneath the ferrules 55 and attached to the upper side of the base 58. The upper end of the fixing rod 52 is joined to a framework 59. The lower end of the fixing rod 52 is provided with a contact portion 521 with an enlarged diameter. The contact portion 521 and the fixing groove 51 are corresponding to each other as a protrusion corresponds to an indentation without relative rotation between the fixing rod 52 and the fixing groove 51. The fixing rod 52 does not exert a downward force to the main body 50. The function of the fixing rod 52 is to restrain the main body 50 from moving or rotating.

The characteristics of the above-mentioned holder is in that only the contact portion 521 of the fixing rod 52 contacts with the fixing groove 51 during the process of the end surface of the respective optical fiber being worked, and the contact plane of the end surface of the respective optical fibers 56 to the polishing surface is approximately the same as a plane of the contact zone to allow the supporting points of the main body 50 to be on a plane of application of force generated from the friction between the optical fiber 56 and the polishing surface 57. Under the circumstances, the phenomenon of the torque being yielded to slant the main body 50 and generate the uneven pressure is incapable of happening.

The counterweights 54 exerting downward forces to the main body 50 allows the end surfaces of the optical fibers 56 to naturally contact with the polishing surface 57. When the polishing surface 57 oscillates up and down, the main body 50 follows the polishing surface 57 to oscillate up and down. Therefore, the contact pressure between the end surface of the respective optical fiber 56 and the polishing surface 57 can be maintained almost all the same. Hence, the end surfaces of the optical fibers in the same batch can obtain the same appearance after polishing so as to promote the polishing speed and quality.

Please refer to FIG. 7. Another preferred embodiment of above-mentioned Taiwan Patent No. 222915 discloses a plurality of symmetrical accepting grooves 61 disposed on the periphery of a main body 60 of a holder for receiving counterweights 62. Accordingly, the end surfaces of optical fibers 63 receive a force respectively to press a polishing surface 64 such that the main body 60 is capable of contacting with the polishing surface 64 naturally. But, the main body 60 is not provided with the fixing groove 51 as the main body 50 shown in FIG. 6A, and a plurality of symmetrical fixing rods 65 are disposed under the lateral sides of the main body 60 with a projecting contact portion 651 disposed at the bottom end of each fixing rod 65 and received in a fixing groove 661 of the framework 66 respectively. A liquid discharge hole 662 is disposed at the lower end of the fixing groove 661 for draining fluid dropped into the fixing groove 661. A contact surface between the contact portion 651 and the fixing groove 661 and a contact surface between the bottoms of the optical fibers 63 and the polishing surface 64 are in the same plane such that the supporting points of the main body 60 can be on a plane of application of force generated by the bottoms of the optical fibers 63 and the polishing surface. Thus, a torque is not possible to be yielded to slant the main body 60, and the phenomenon of the uneven pressure can be avoided.

The currently used conventional polishing machine for the end surface of an optical fiber normally polishes twelve end surfaces every time, and at most forty eight or sixty four end surfaces are polished at one time. If more end surfaces have to be polished at one time under a condition of the pressure being not uniformly distributed, it needs more time to completely polish the end surface with less pressure. But, it affects the polishing efficiency substantively. Therefore, a uniform distribution of pressure is very important for polishing a great deal of end surfaces of the optical fibers.

SUMMARY OF THE INVENTION

For further improving the structure of the supporting points of a holder for the holder being parallel to a polishing surface in the process of polishing and increasing the number of the end surfaces of the optical fibers being capable of being polished simultaneously so as to enhance the polishing speed and quality, the present invention is proposed.

The main object of the present invention is to provide a holder for supporting an end surface of a workpiece under a condition of the holder keeping parallel to a plane of application of force.

Another object of the present invention is to provide a holder for supporting an end surface of a workpiece during polishing such that the holder can naturally contact with a framework, and the end surface of the optical fiber can contact with a polishing surface naturally and be subjected to a uniform pressure.

For attaining the objects mentioned above, a holder for supporting an end surface of a workpiece during polishing according to the present invention is proposed; the holder comprises a main body and a framework, wherein the main body provides a plurality of fixtures for clamping workpieces; the main body and the framework are provided with a fixing portion respectively to correspond to each other; at least one of the two fixing portions has at least one set of an upper contact portion and a lower contact portion, and the upper and lower contact portions disposed at the upper side and the lower side of a contact plane between the end surface and a polishing surface. The upper and lower contact portions contact another fixing portion for the main body keeping parallel to the polishing surface to promote the polishing speed and quality.

BRIEF DESCRIPTION OF THE DRAWINGS

The present invention can be more fully understood by reference to the following description and accompanying drawings, in which:

FIG. 1 is a schematic view of the conventional optical fiber connecter;

FIG. 2 is a perspective view of the conventional polishing apparatus;

DETAILED DESCRIPTION OF THE PREFERRED EMBODIMENTS

Figure 8A:
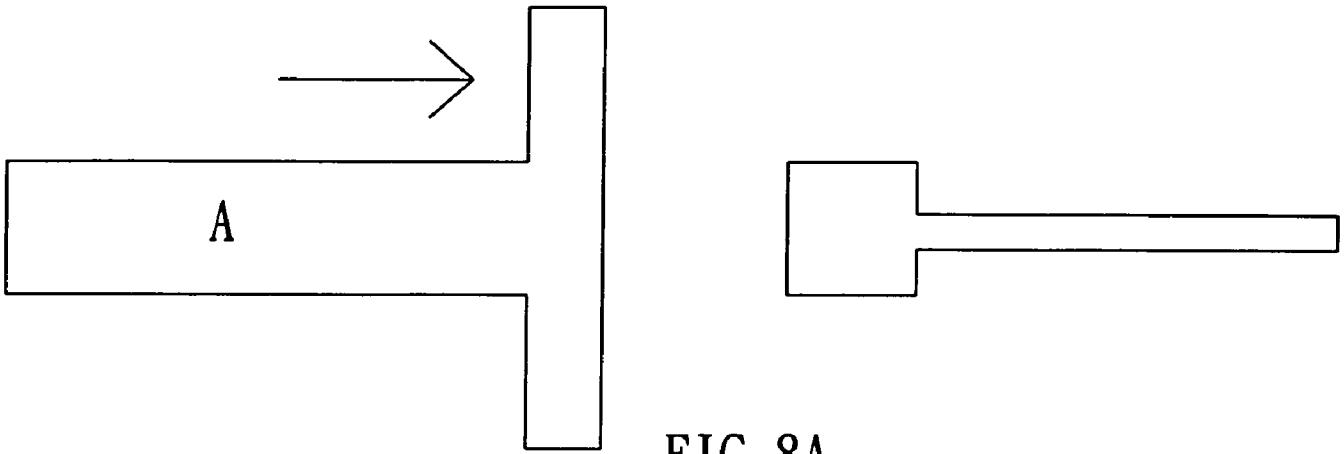
FIG. 8A is a schematic view illustrating a structure of the first way for withstanding an object.
Figure 8B:
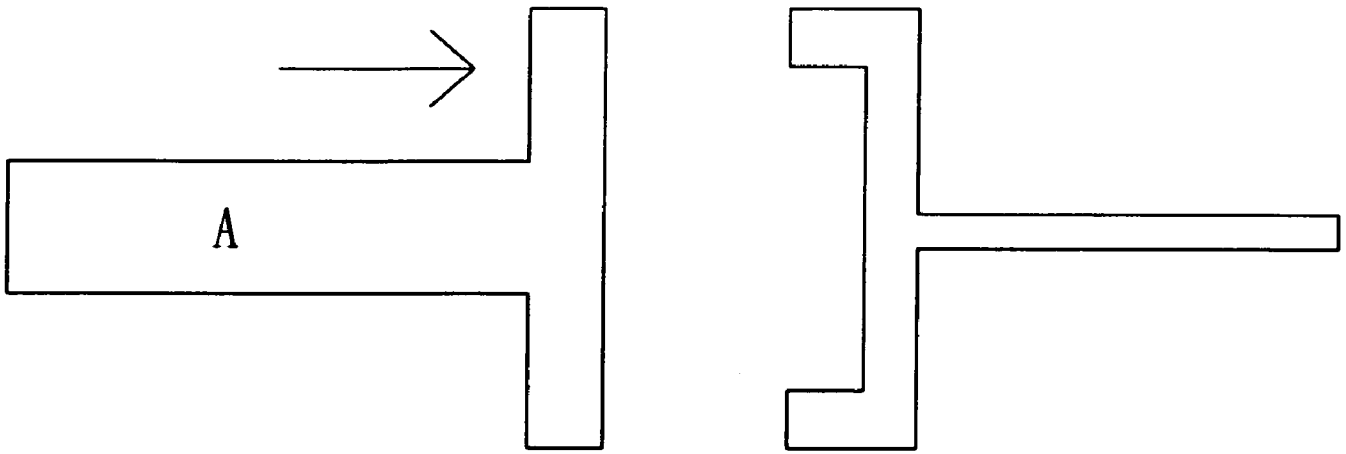
FIG. 8B is a schematic view illustrating a structure of the second way for withstanding an object.

Please refer to FIGS. 8A and 8B. From the viewpoint of dynamics, if an object A is moved from the left to the right, there are at least two different structures for withstanding the object A shown in FIGS. 8A and 8B. It is obvious that the structure shown in FIG. 8B is better than the structure shown in FIG. A for withstanding the object A. It is because that there is only one supporting point shown in FIG. 8A, and the structure shown in FIG. 8B has both of the upper and lower supporting points to withstand the object A. It is more stable to withstand the object A without slanting the object A an angle with the structure shown in FIG. B.

Figure 6A:
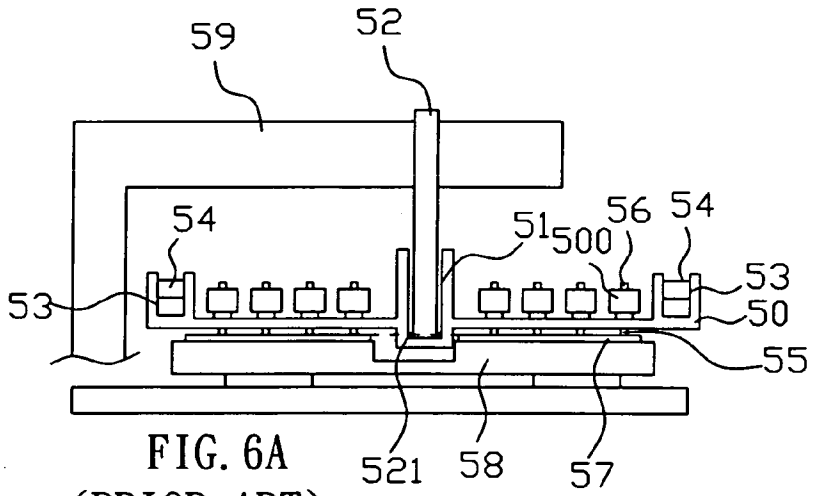
FIG. 6A (PRIOR ART)
FIG. 6A is a fragmentary schematic view of a holder structure of a preferred embodiment disclosed by Taiwan patent No. 222915.
Figure 6B:
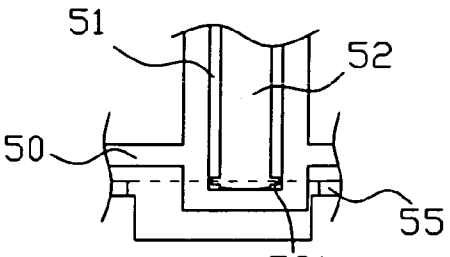
FIG. 6B (PRIOR ART)
FIG. 6B is a fragmentary enlarged view part of FIG. 6A.
Figure 9B:
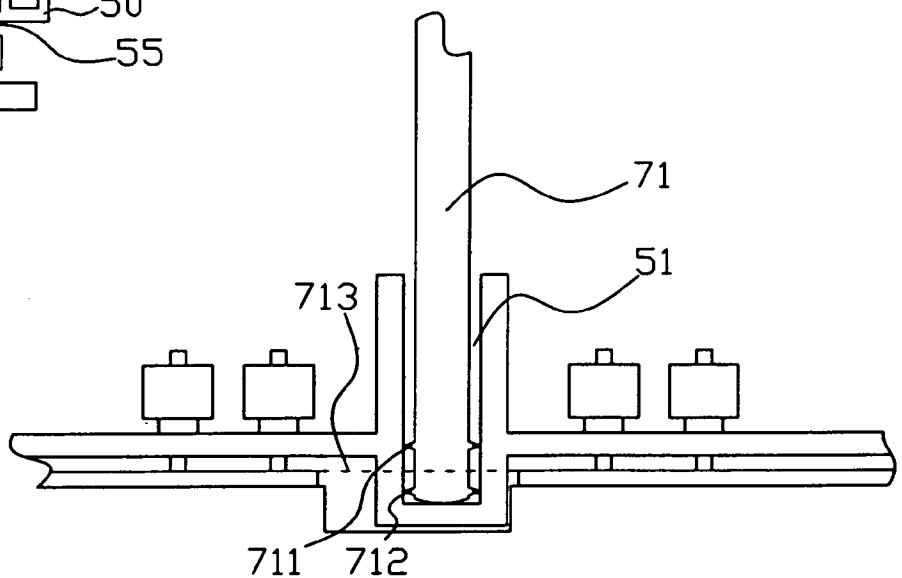
FIG. 9B is a fragmentary enlarged view showing part of FIG. 9A.
Figure 9A:
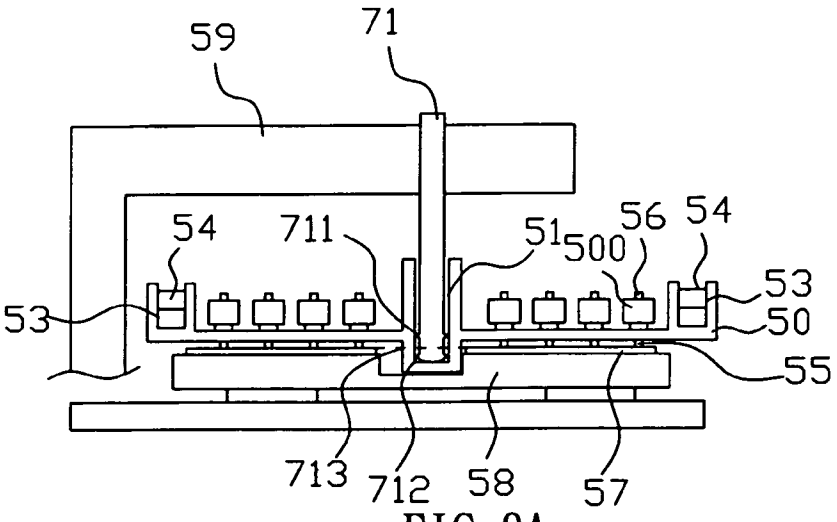
FIG. 9A is a fragmentary schematic view showing the first implementation of the first embodiment according to the present invention.

Please refer to 6A, 9A and 9B. The holder of the first preferred embodiment of the present invention is approximately the same as the holder shown in FIG. 6A except that a set of upper and lower contact portions 711 and 712 projecting from the outer wall of the bottom of a fixing rod 71 shown in FIGS. 9A and 9B is different from only one contact portion 521 being disposed on the fixing rod 51 shown in FIG. 6A. The upper contact portion 711 and the lower contact portion 712 are respectively disposed above and below a contact plane 713 between the end surfaces of the optical fibers 56 and a polishing surface 57. It is noted that the contact plane 713 is illustrated as a dash line shown in FIGS. 9A and 9B, and it is preferable that the upper contact portion 711 and the lower contact portion 712 are disposed with an equal distance from the contact plane 713. The polishing surface 57 can be a hard or elastic polishing surface.

In the process of polishing, the holder of the present invention is subjected to a restriction of the upper and lower contact portions 711, 712 contacting the inner wall of the fixing groove 51 such that the inner wall of the fixing groove 51 keeps parallel to the fixing rod 71 to the fullest extent possible for the main body 50 to keep parallel to the polishing surface 57. Thus, the pressure acting on the end surface of each optical fiber 56 is uniform, and it is applicable for polishing the end surfaces of a large number of optical fibers.

Figure 9D:
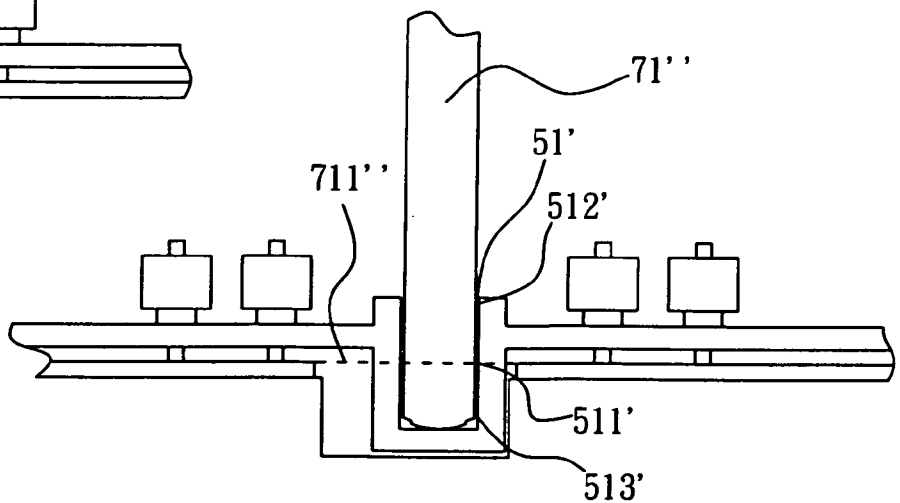
FIG. 9D is a fragmentary schematic view showing the third implementation of the first embodiment according to the present invention.
Figure 9C:
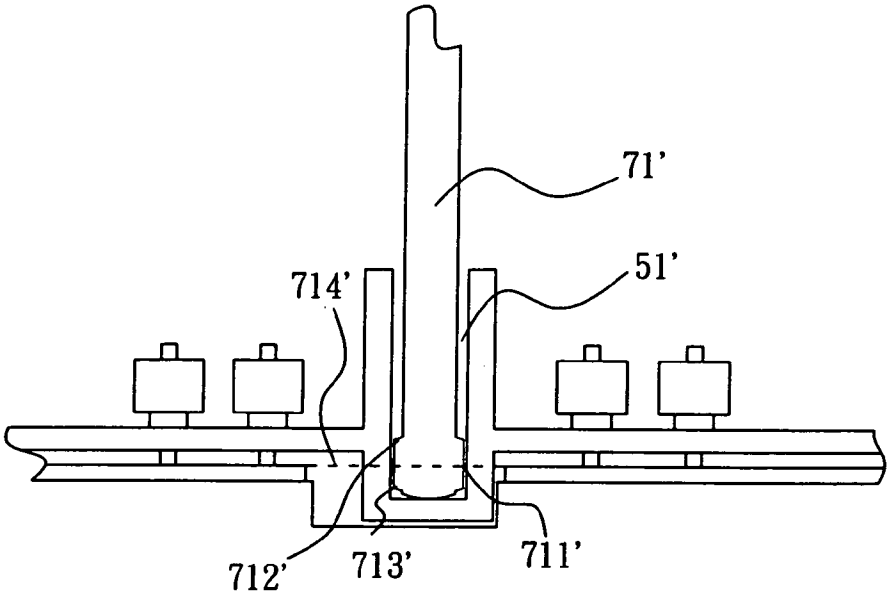
FIG. 9C is a fragmentary schematic view showing the second implementation of the first embodiment according to the present invention.

Please refer to FIGS. 9B and 9C. The second implementation of the first embodiment of the present invention provides a projection section 711' at the bottom end of the fixing rod 71' with the upper and lower edges of the projection section 711' forming the upper and lower contact portions 712', 713'. The upper and lower contact portions 712' and 713' are respectively disposed above and below a contact plane 714' between the end surface of the respective optical fiber and a polishing surface, and it is preferable that the upper and lower contact portions 711, 712 have an equal distance from the contact plane 714'; it can attain the same effect as the upper and lower contact portions 711 and 712 disposed at the bottom of the fixing rod 71 shown in FIG. 9B. The second implementation of the present embodiment can also be applied to other embodiments.

Figure 4:
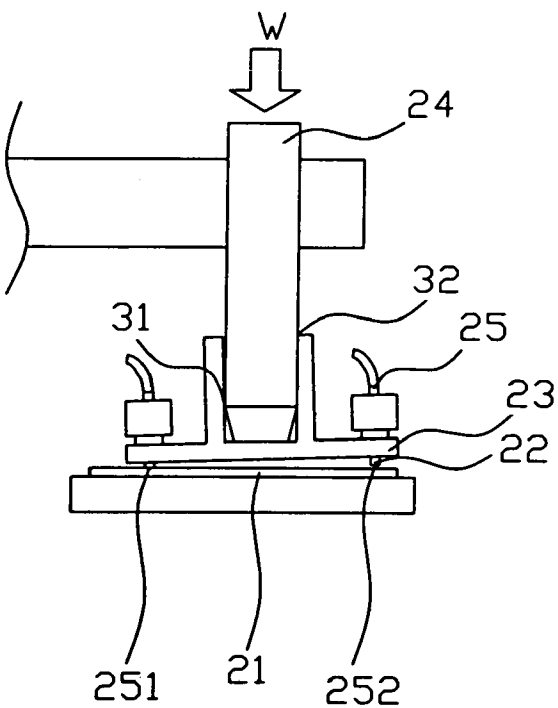
FIG. 4 (PRIOR ART)
FIG. 4 is a fragmentary schematic view of the conventional polishing apparatus shown in FIG. 3 in use.
Figure 3:
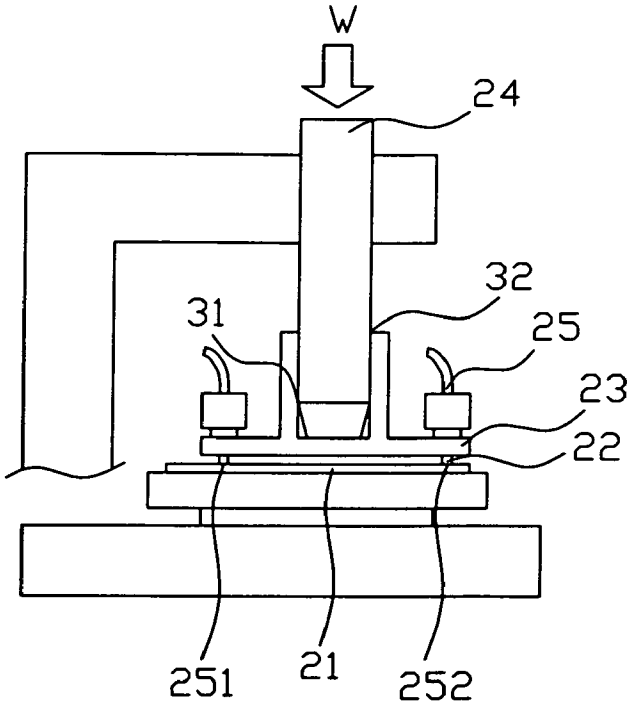
FIG. 3 (PRIOR ART)
FIG. 3 is a fragmentary schematic view of the conventional polishing apparatus.
Figure 5:
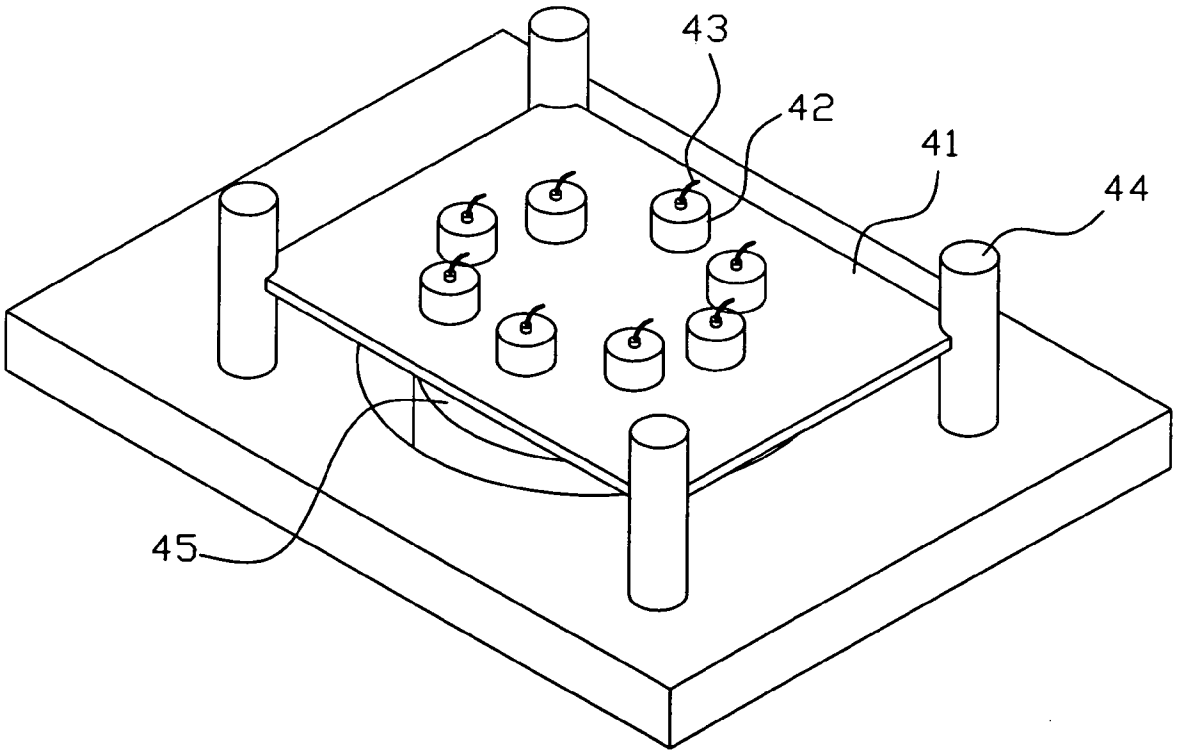
FIG. 5 (PRIOR ART)
FIG. 5 is a perspective view of the conventional holder with fixtures.

Please refer to FIGS. 9B and 9D. The third implementation of the first embodiment of the present invention is illustrated. A fixing groove 51' for receiving the bottom end of a fixing rod 71" has an inner wall 511' with the upper and lower ends of the inner wall 511' being respectively upper and lower contact portions 512' and 513'. The upper and lower contact portions 512' and 513' are respectively disposed above and below a contact plane 711" between the end surface of an optical fiber and a polishing surface, and it is preferable that the upper and lower contact portions 512', 513' have an equal distance from the contact plane 711". Hence, it can also attain the same effect as the projecting upper and lower contact portions 711 and 712 disposed at the outer wall of the bottom of the fixing rod 71 shown in FIG. 9A. The third implementation of the present embodiment is completely different from the structure of the conventional holder 23 shown in FIGS. 3 and 4 that the contact point 31 and the contact point 32 are all higher than the contact plane between the end surface of the optical fiber and the polishing surface. The supporting points shown in FIGS. 9C and 9D are at the upper contact portion 512' and the lower contact portion 513' and are respectively above and below the contact plane 711" between the end surface of the optical fiber and the polishing surface such that the holder is not subjected to a counterclockwise torque. The third implementation of the present embodiment can also be applied to other embodiments.

Figure 10:
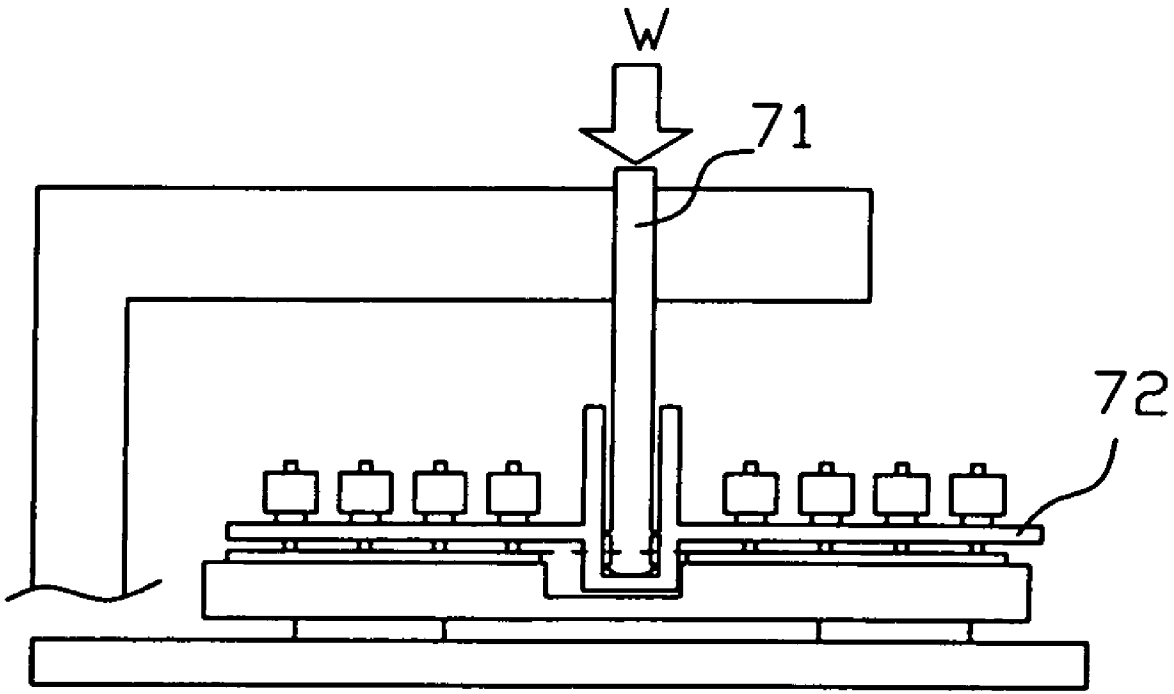
FIG. 10 is a fragmentary schematic view showing the second preferred embodiment according to the present invention.

Please refer to FIGS. 9A and 10. The structure of a holder of the second preferred embodiment according to the present invention is almost the same as the holder shown in FIG. 9A except that a main body 72 shown in FIG. 10 is not provided with the accepting groove 53 of the main body 50 shown in FIG. 9A. It is noted that a fixing rod 71 of the present embodiment is operated to exert a downward force to the main body 72, and it allows the end surface of each optical fiber to be subjected to a uniform pressure such that it is applicable for polishing the end surfaces of a large number of optical fibers simultaneously.

Figure 11B:
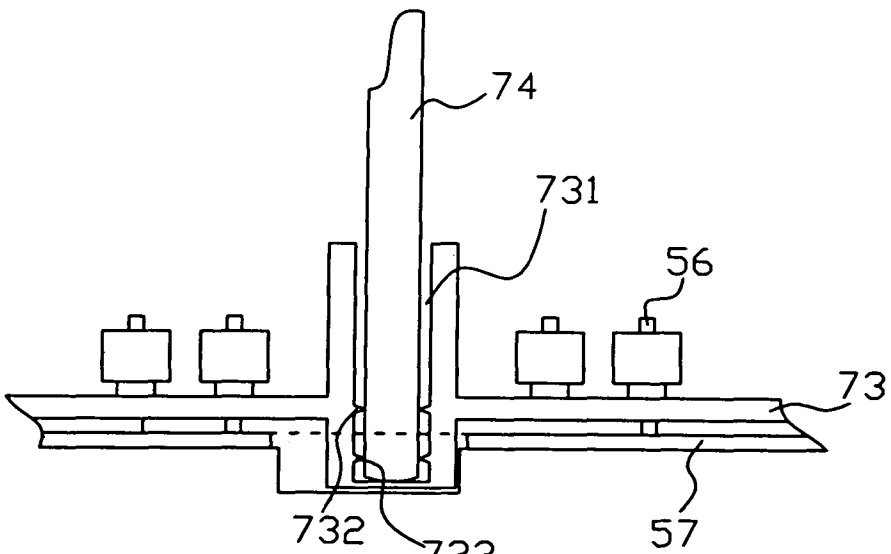
FIG. 11B is a fragmentary enlarged view showing part of FIG. 11A.
Figure 11A:
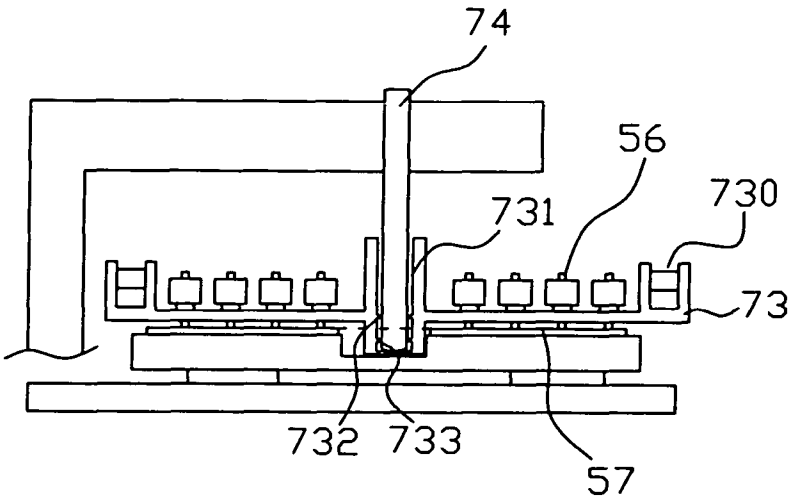
FIG. 11A is a fragmentary schematic view showing the third preferred embodiment according to the present invention.

Please refer to FIGS. 9A, 11A and 11B. The third preferred embodiment of the present invention is illustrated. The structure of the holder shown in FIGS. 11A and 11B is almost the same as the holder shown in FIG. 9A except that the inner wall of a fixing groove 731 of a main body 73 is provided with one set of upper and lower contact portions 732 and 733 projecting toward the groove instead of the contact portions 711, 712 shown in FIG. 9A being provided on a fixing rod 74. The upper contact portion 732 and the lower contact portion 733 are disposed above and below a contact plane between the end surface of the respective optical fiber 56 and the polishing surface 57, and it also allows the end surface of each optical fiber to be subjected to a uniform pressure such that it is applicable for polishing the end surfaces of a larger number of optical fibers simultaneously.

Figure 12:
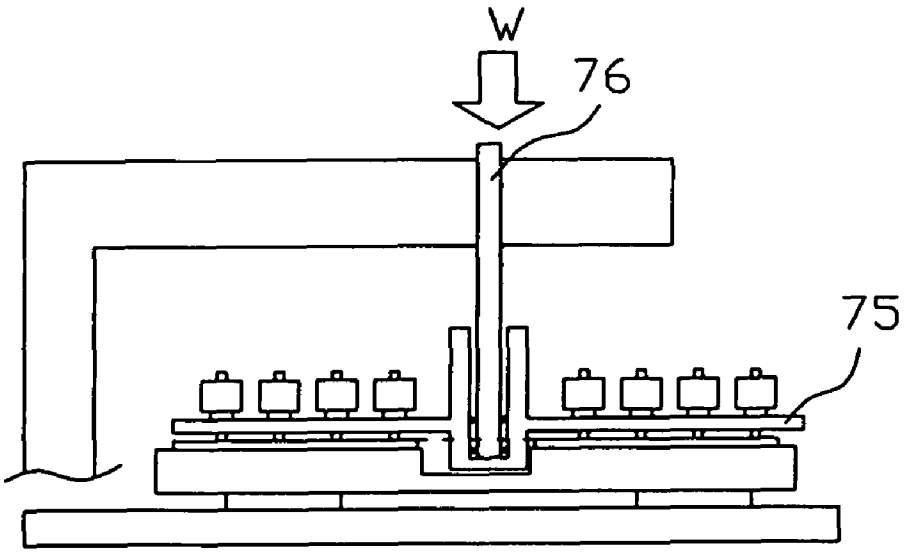
FIG. 12 is a fragmentary schematic view showing the fourth preferred embodiment according to the present invention.

Please refer to FIGS. 11A and 12. The fourth preferred embodiment according to the present invention is illustrated. The structure of the hold shown in FIG. 12 is almost the same as the holder shown in FIG. 11A except that the main body 75 shown in FIG. 12 is not provided with the accepting grooves 730 as the main body 73 shown in FIG. 11A does, and the fixing rod 76 shown in FIG. 12 exerts a downward force to the main body 75; it also allows the end surface of each optical fiber to be subjected to a uniform pressure such that it is applicable for polishing the end surfaces of a large number of optical fibers simultaneously.

Figure 7:
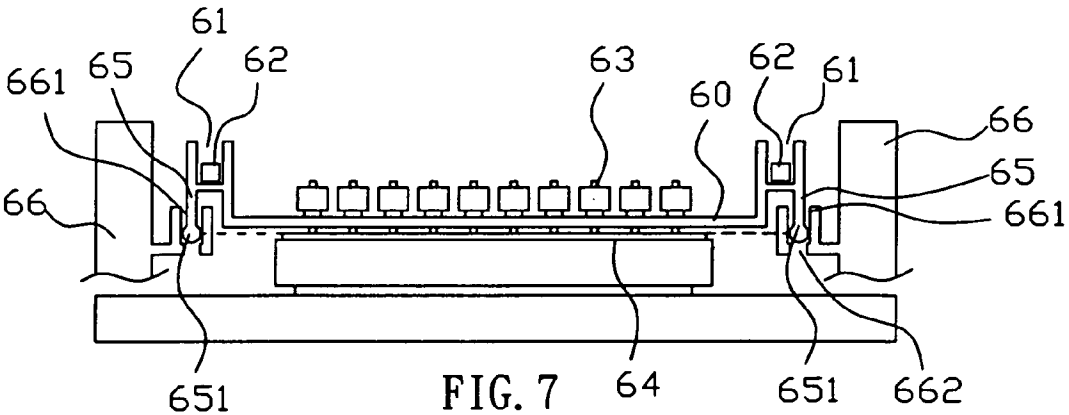
FIG. 7 (PRIOR ART)
FIG. 7 is a fragmentary schematic view of a holder structure of another preferred embodiment disclosed by Taiwan patent No. 222915.
Figure 13:
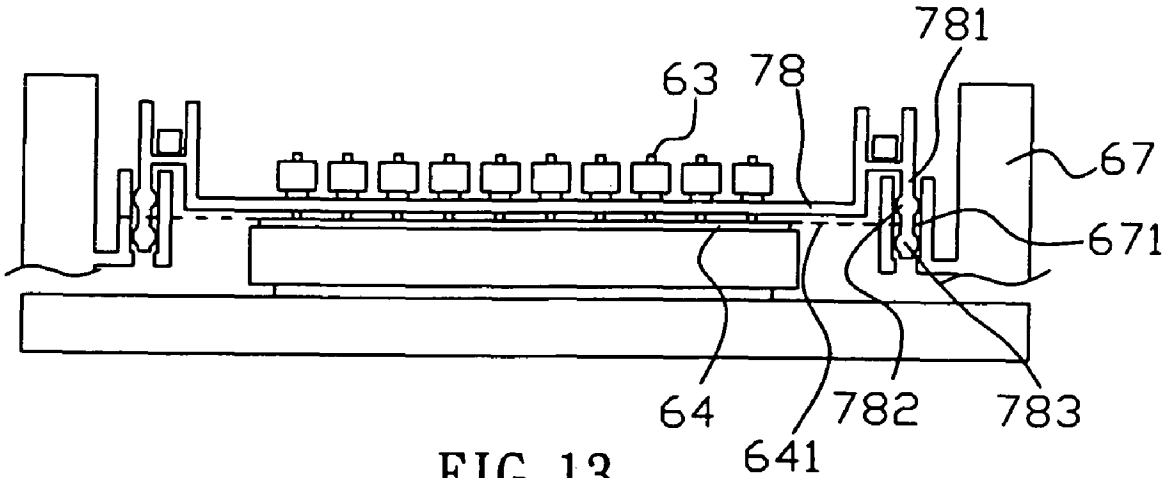
FIG. 13 is a fragmentary schematic view showing the fifth preferred embodiment according to the present invention.

Please refer to FIGS. 7 and 13. The fifth preferred embodiment of the present invention is illustrated. The structure of the holder shown in FIG. 13 is almost the same as the holder shown in 7 except that the bottom of a fixing rod 781 of a main body 78 shown in FIG. 13 is provided with one set of projecting upper and lower contact portions 782, 783, and a fixing groove 671 of a framework 67 shown in FIG. 13 is longer. FIG. 7 shows that the fixing rod 65 is merely provided with one contact portion 651, and the fixing groove 661 of the framework 66 is shorter. The upper contact portion 782 and the lower contact portion 783 are respectively disposed above and below a contact plane 641 between the end surface of the optical fiber 63 and the polishing surface 64. A liquid discharge hole is disposed at the lower end of the fixing groove 671.

In the process of polishing, the holder of the fifth embodiment allows the fixing rod 781 to keep parallel to the inner wall of the fixing groove 671, and allows the main body 78 to keep parallel to the polishing surface 64 with the upper and lower contact portions 782, 783 contacting with the inner wall of the fixing groove 671 such that the pressure acting on the end surface of each optical fiber 63 is uniform. Hence, it becomes applicable for polishing the end surfaces of a large number of optical fibers simultaneously.

Figure 14:
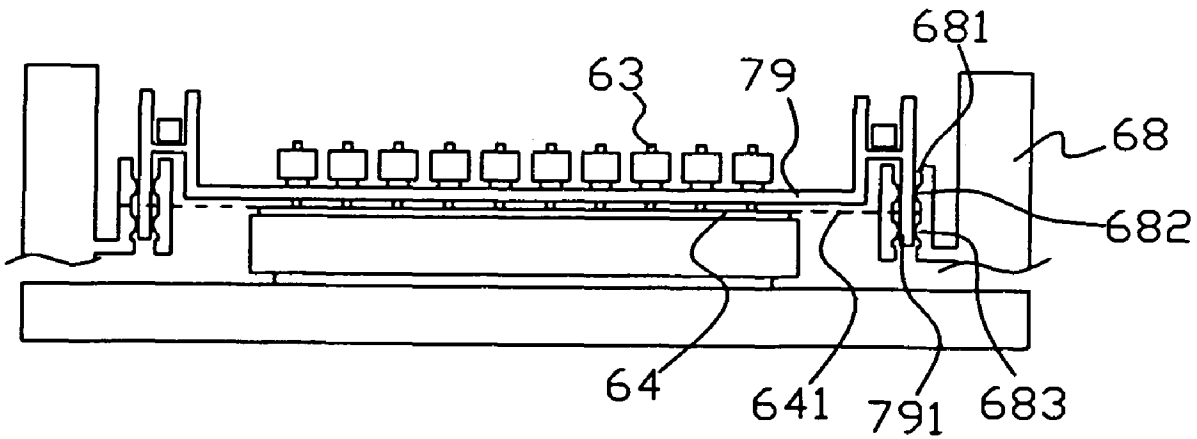
FIG. 14 is a fragmentary schematic view showing the sixth preferred embodiment according to the present invention.

Please refer to FIGS. 13 and 14. The sixth preferred embodiment of the present invention is illustrated. The structure of the holder shown in FIG. 14 is almost the same as the holder shown in FIG. 13 except that the inner wall of a fixing groove 681 of a framework 68 is provided with one set of upper and lower contact portions 682 and 683 projecting toward the groove instead of a fixing rod 791 of a main body 79 being provided with the upper and lower contact portions 782, 783 shown in FIG. 13. The upper contact portion 682 and the lower contact portion 683 are disposed above and below a contact plane between the end surface of the respective optical fiber 63 and the polishing surface 64. It also allows the pressure acting on the end surface of each optical fiber to be uniform such that it is applicable for polishing the end surfaces of a large number of optical fibers simultaneously. A liquid discharge hole is disposed at the lower end of the fixing groove 681.

Figure 15A:
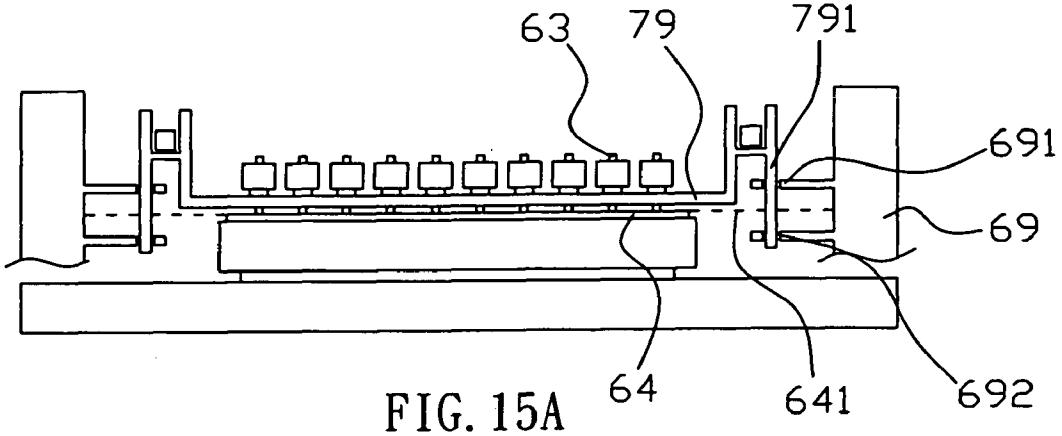
FIG. 15A is a fragmentary schematic view showing the first implementation of the seventh embodiment according to the present invention.
Figure 15B:
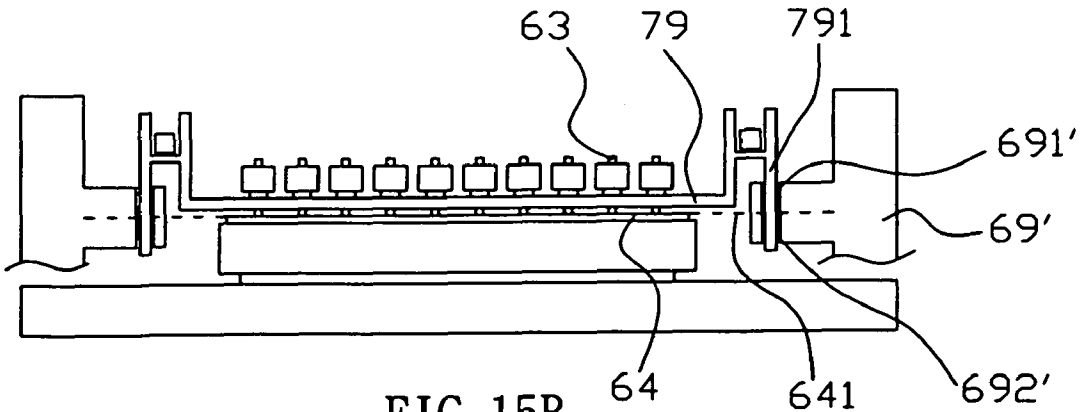
FIG. 15B is a fragmentary schematic view showing the second implementation of the seventh embodiment according to the present invention.
Figure 15C:
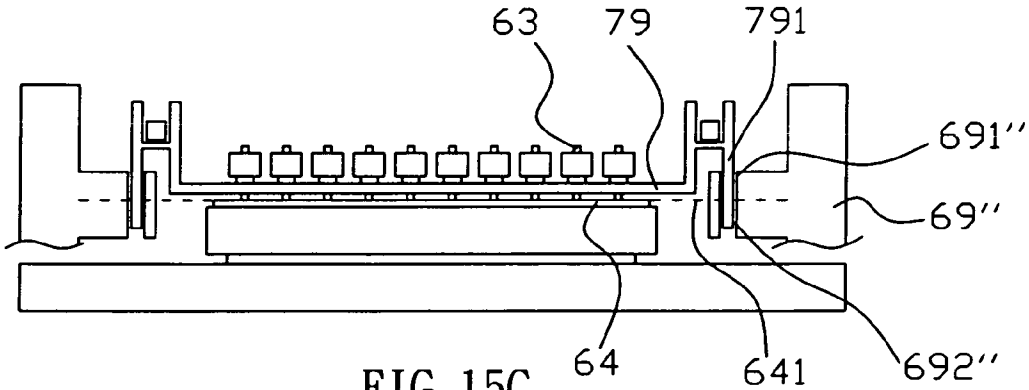
FIG. 15C is a fragmentary schematic view showing the third implementation of the seventh embodiment according to the present invention.

Please refer to FIGS. 14, 15A, 15B and 15C. The seventh preferred embodiment according to the present invention is illustrated. The structure of the holder shown in FIGS. 15A, 15B and 15C is almost the same as the holder shown in FIG. 14 except that a framework 69 shown in FIG. 15A is provided with a plurality of sets of circular upper and lower contact portions 691 and 692 extending toward one side of a main body 79, the upper and the lower ends of the fixing groove of a framework 69' shown in FIG. 15B are respectively provided with the upper and lower contact portions 691' and 692', and the upper end of the fixing groove of a framework 69" shown in FIG. 15C is an upper contact portion 691" together with a portion of the inner wall of the fixing groove of the framework 69" corresponding to a fixing rod 791 of a main body 73 is a lower contact portion 692" respectively instead of the upper and lower contact portions 682 and 683 disposed at the inner wall of the fixing groove 681 shown in FIG. 14. The upper contact portions 691, 691' and 691", and the lower contact portions 692, 692' and 692" are respectively disposed above and below the contact plane 641 between the end surface of the respective optical fiber 63 and the polishing surface 64 to suppress the oscillation of the main body 79 yielding in the process of polishing such that the fixing rod 791 keeps parallel to the inner wall of the fixing groove, the main body 79 keeps parallel to the polishing surface 64, and the pressure acting on the end surface of each optical fiber is uniform. Hence, it is applicable for polishing the end surfaces of a large number of optical fibers simultaneously by the upper contact portions 691, 691' and 691" and the lower contact portions 692, 692' and 692" of the framework 69 respectively contacting with the fixing rod 791. A liquid discharge hole is disposed at the lower end of the fixing groove of the framework.

Figure 16A:
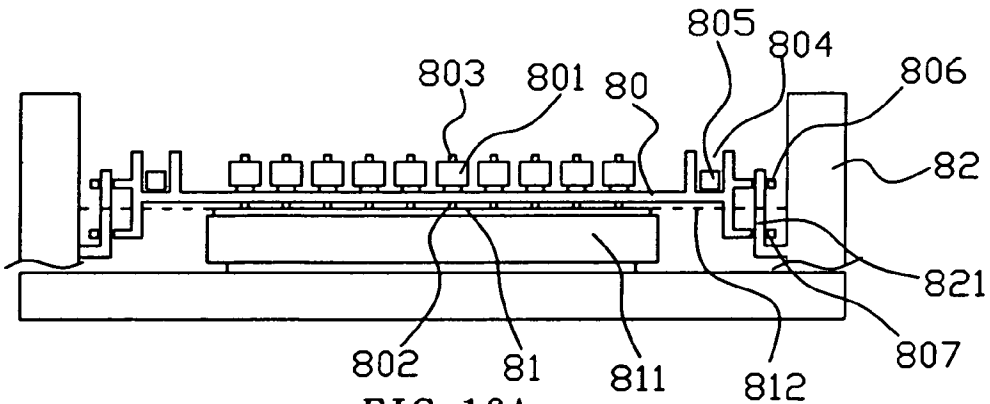
FIG. 16A is a fragmentary schematic view showing the first implementation of the eighth embodiment according to the present invention.
Figure 16B:
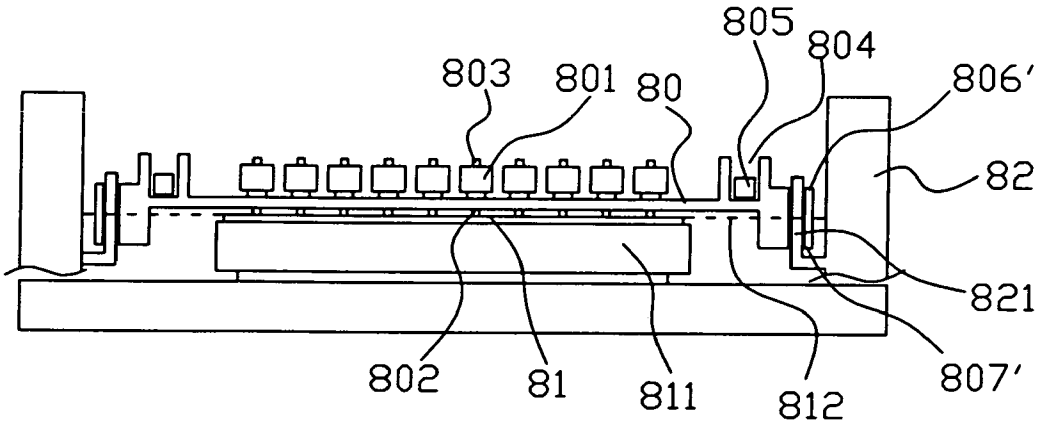
FIG. 16B is a fragmentary schematic view showing the second implementation of the eighth embodiment according to the present invention.
Figure 16C:
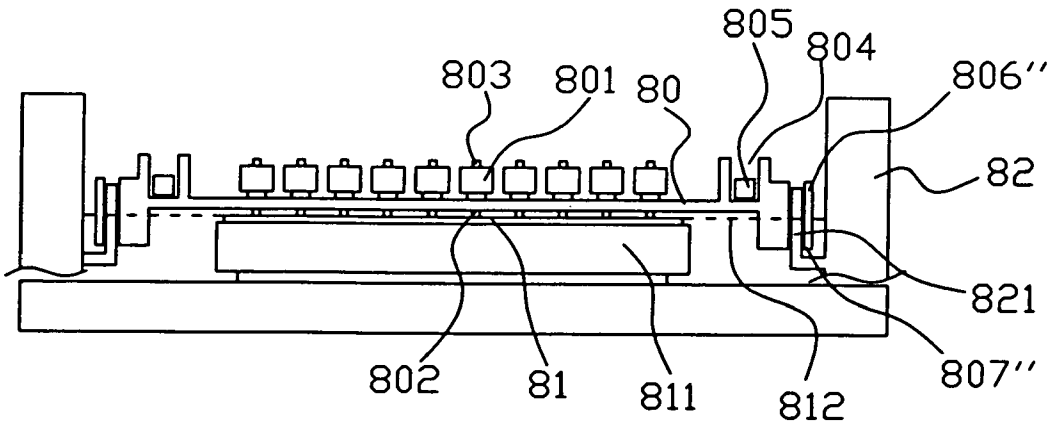
FIG. 16C is a fragmentary schematic view showing the third implementation of the eighth embodiment according to the present invention.

Please refer to FIGS. 16A, 16B and 16C. The eighth preferred embodiment of the present invention is illustrated. The holder shown in FIGS. 16A, 16B and 16C comprises a main body 80 and a plurality of fixtures 801 attached to the main body 80 in which each fixture 801 is combined with at least one ferrule 802 joined to an optical fiber 803. A polishing surface 81 is attached to the upper side of a base 811 and disposed below the ferrule 802. A plurality of symmetrical accepting grooves 804 are disposed at the periphery of the main body 80 to accept counterweights 805. The main body 80 is provided with a fixing portion. The fixing portion can be a plurality of sets of symmetrical circular upper and lower contact portions 806 and 807 extending outward from the main body 80 shown in FIG. 16A, the upper and lower ends of the fixing grooves of the main body 80 are upper and lower contact portions 806' and 807' shown in FIG. 16B, or a portion of the inner wall of the fixing groove of the main body 80 corresponding to the upper end of a fixing rod 821 of a framework 82 is an upper contact portion 806" together with the lower end of the fixing groove of a main body 80" being a lower contact portion 807" shown in FIG. 16C. The framework 82 is provided with another fixing portion, and the fixing portion is a fixing rod 821 which respectively corresponds to the upper contact portions 806, 806' and 806" and the lower contact portions 807, 507' and 807". Each one of the upper contact portions 806, 806' and 806" and each one of the lower contact portions 807, 507' and 807" respectively fit with the fixing rod 821 to restrain the main body 80 from moving or rotating. The upper contact portions 806, 806' and 806" and the lower contact portions 807, 807' and 807" are respectively disposed above and below the contact plane 812 between the end surface of the respective optical fiber 803 and the polishing surface 81 to suppress the oscillation of the main body 80 yielding in the process of polishing such that the inner wall of the fixing groove is capable of keeping parallel to the fixing rod 821, and the main body 80 is capable of keeping parallel to the polishing surface 81 for the pressure acting on the end surface of each optical fiber being uniform. Hence, it is applicable for polishing the end surfaces of a large number of the optical simultaneously by the upper contact portions 806, 806' and 806" and the lower contact portions 807, 807' and 807" of the main body 80 respectively contacting with the fixing rod 821.

Every kind of structure of corresponding upper and lower contact portions disclosed in the seventh and the eighth embodiments of the present invention can also be applied to other embodiments.

Figure 17:
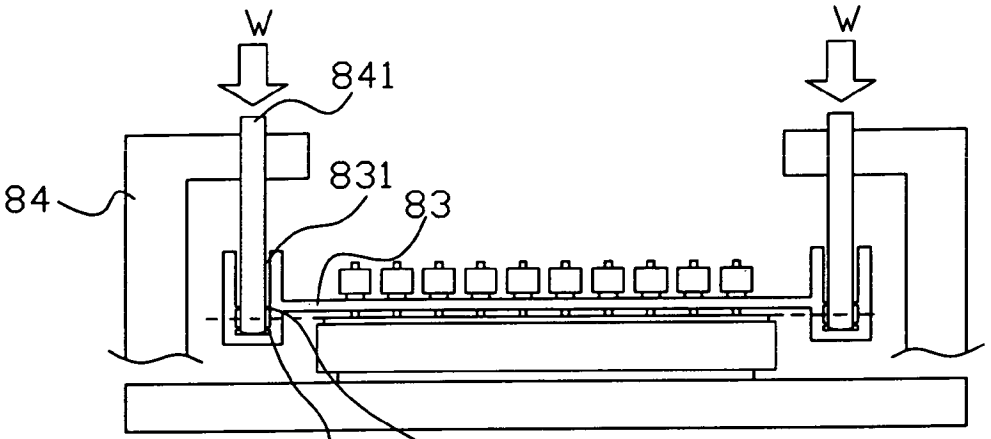
FIG. 17 is a fragmentary schematic view showing the ninth preferred embodiment according to the present invention.

Please refer to FIGS. 12 and 17. The ninth preferred embodiment according to the present invention is illustrated. The structure of the holder shown in FIG. 17 is almost the same as the holder shown in FIG. 12 except that a plurality of symmetrical fixing grooves 831 are disposed on the periphery of a main body 83 with each fixing groove 831 receiving a fixing rod 841 instead of the structure of one fixing groove fitting with one fixing rod 76 only at the center of the main body 72 shown in FIG. 12. Besides, it can be seen in FIG. 17 that each fixing groove 831 is provided with one set of upper and lower contact portions 832 and 833, a framework 84 is joined to the upper side of each fixing rod 841, and each fixing rod 841 exerts a downward force to the main body 83.

Figure 18:
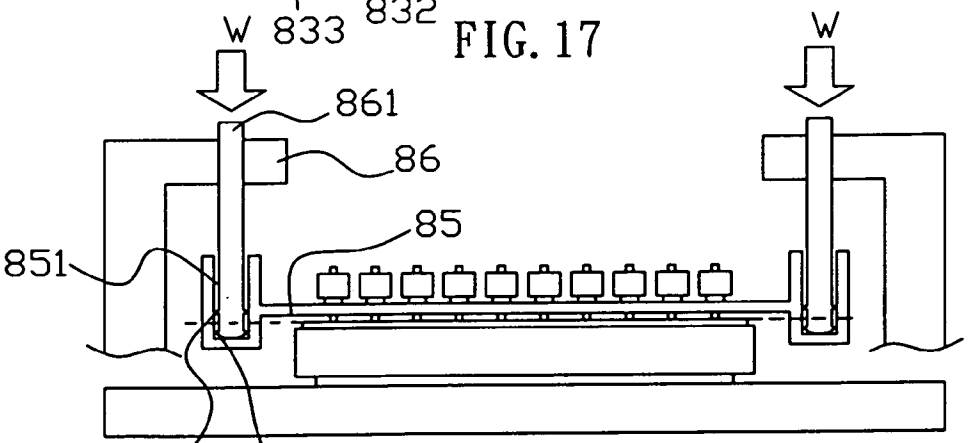
FIG. 18 is a fragmentary schematic view showing the tenth preferred embodiment according to the present invention.

Please refer to FIGS. 17 and 18. The tenth preferred embodiment according to the present invention is illustrated. The structure of the holder shown in FIG. 18 is almost the same as the holder shown in FIG. 17 except that the inner wall of a fixing groove 851 of a main body 85 is not provided with the upper and the lower contact portions 832 and 833 shown in FIG. 17, and a fixing rod 861 is provided with upper and lower contact portions 862 and 863. Further, it can be seen in FIG. 18 that the upper side of each fixing rod 861 is joined to a framework 86, and each fixing rod 861 exerts a downward force to the main body 85.

Figure 19:
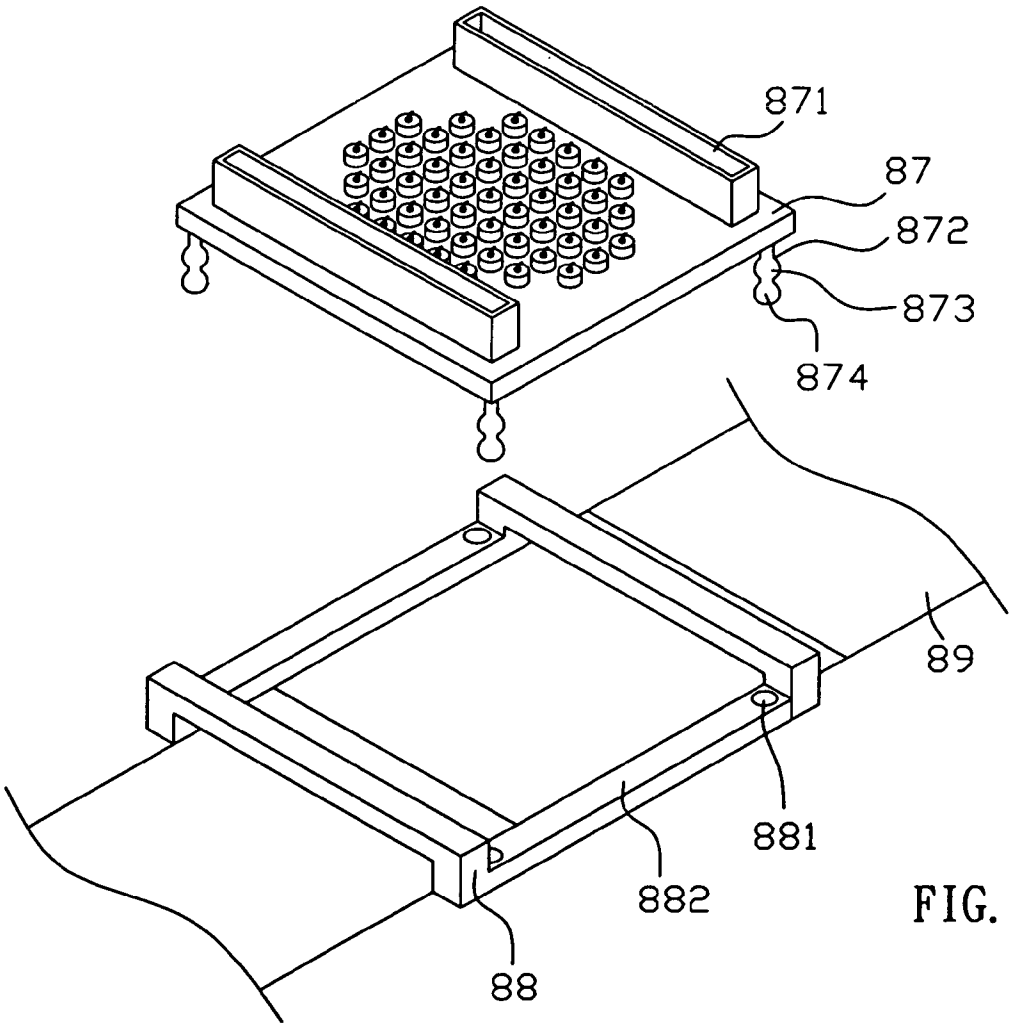
FIG. 19 is a perspective view showing the eleventh preferred embodiment according to the present invention.

Please refer to FIG. 19. The eleventh preferred embodiment according to the present invention is illustrated. A plurality of symmetrical accepting grooves 871 for receiving counterweights are disposed above a main body 87 of the holder, and a plurality of symmetrical fixing rods 872 are disposed beneath the bottom of the main body 87. The bottom ends of the fixing rods 872 are provided with one set of upper and lower contact portions 873 and 874 projecting outward from the fixing rods 872 respectively. The upper and lower contact portions 873 and 874 are accepted in a fixing groove 881 of a casing type framework 88. The framework 88 is provided with one pair of indented sides 882 and the bottom of the fixing groove 881 is provided with a liquid discharge hole. The fixing groove 881 is disposed at the indented side 882. The framework 88 can be moved above a continuous polishing surface 89 so as to perform a polishing operation on the polishing surface 89 with polishing particles in different coarsenesses.

Figure 20:
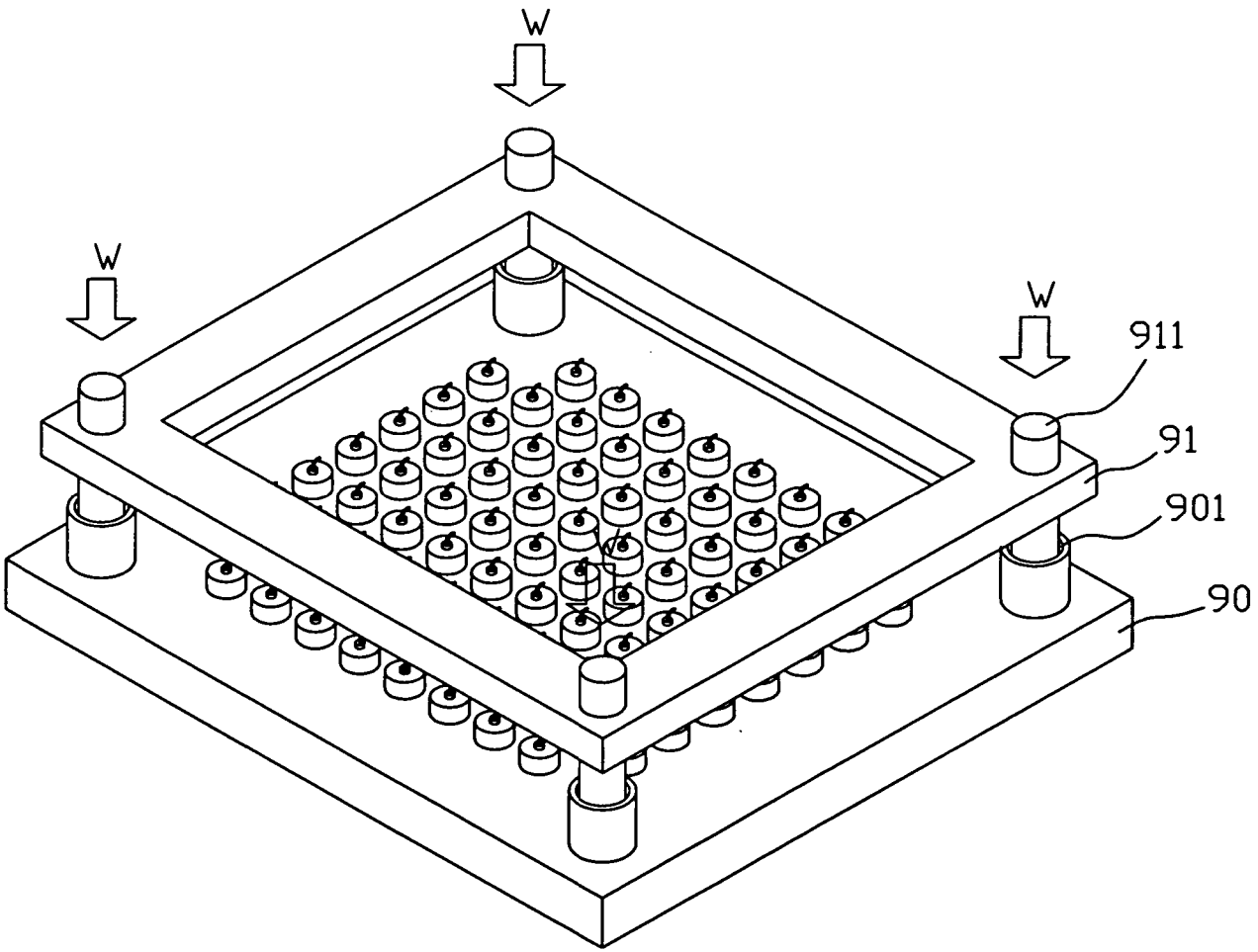
FIG. 20 is a perspective view showing the twelfth preferred embodiment according to the present invention.

Please refer to FIG. 20. The twelfth preferred embodiment according to the present invention is illustrated. A plurality of symmetrical fixing grooves 901 are disposed on the periphery of a main body 90 of the holder shown in FIG. 20 for receiving corresponding fixing rods 911. The respective fixing rod 911 is joined to a casing type framework 91 to exert a downward force to a main body 90. The upper and lower contact portions are disposed between the fixing groove 901 and the fixing rod 911 of this embodiment. The structures for the upper and lower contact portions are the same as those mentioned in the previous embodiments, and no details will be recited further.

It can be realized from the preceding embodiments of the present invention that the fixing portion of the main body and the fixing portion of the framework can be the fixing rods and the fixing grooves with the corresponding upper and lower contact portions, or the corresponding annular upper and lower contact portions with the fixing rod.

Figure 22:
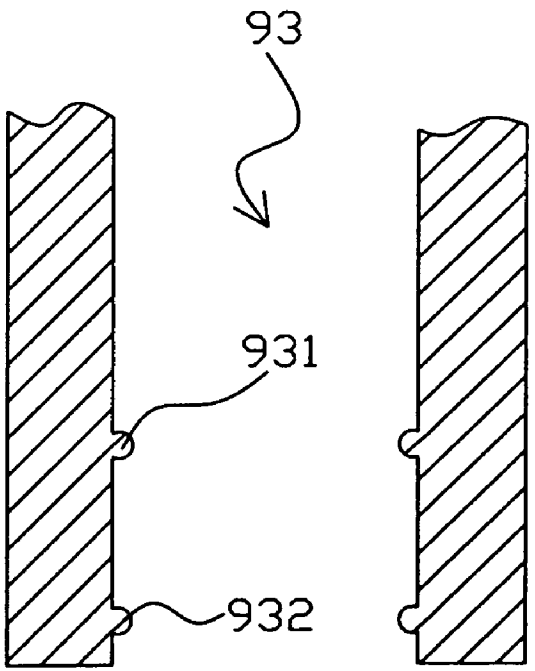
FIG. 22 is a sectional view showing the first embodiment of a fixing groove according to the present invention.
Figure 21:
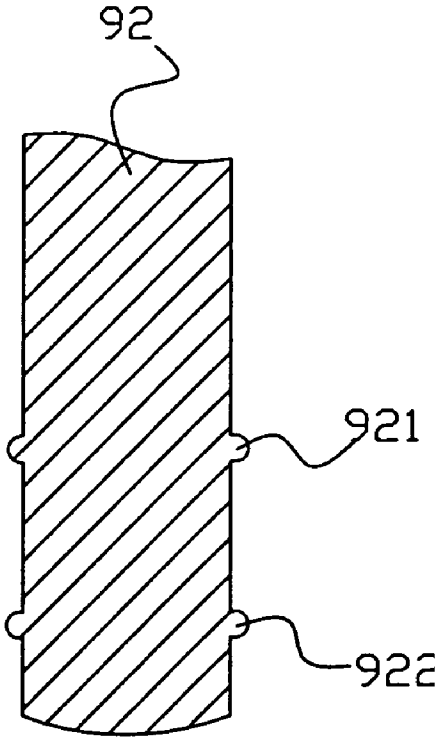
FIG. 21 is a sectional view showing the first embodiment of a fixing rod according to the present invention.
Figure 24:
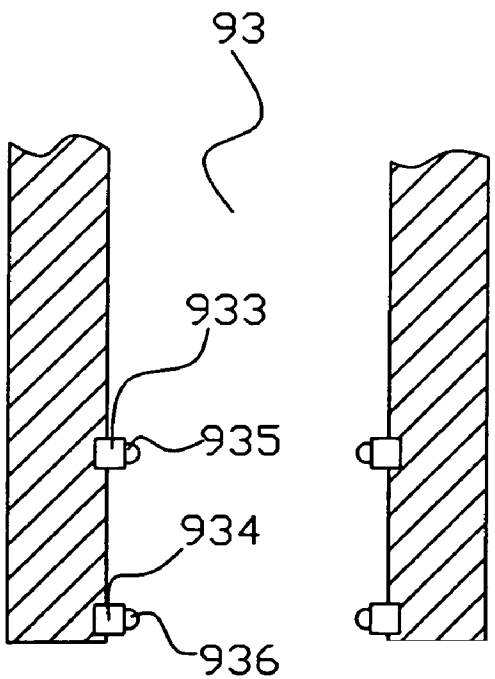
FIG. 24 is a sectional view showing the second embodiment of the fixing groove of a second embodiment according to the present invention.
Figure 23:
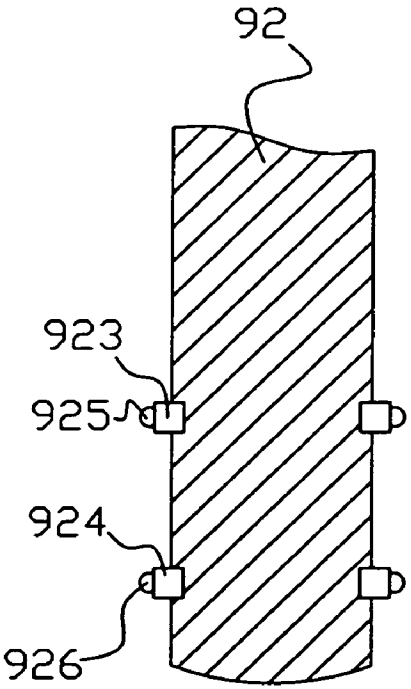
FIG. 23 is a sectional view showing the second embodiment of the fixing rod according to the present invention.

Another key problem is that it is necessary to pressurize the holder in the process of polishing. The holder can be pressurized with counterweights, hydraulics, or pneumatics. Besides, the polishing surface oscillates a little up and down in the process of polishing. For maintaining the uniform pressure, the holder and the polishing surface need to naturally contact with each other. That is, when the polishing surface oscillates up and down, the holder also follows the polishing surface to oscillate up and down. Meanwhile, it is preferable that the contact portions disposed on the main body or the framework have extending and retracting movements corresponding to the oscillation of the holder. The upper and lower contact portions disposed in the respective fixing groove, framework and fixing rod can be designed differently depending on the magnitude of the oscillation of the polishing surface. The upper contact portions 921, 931 and the lower contact portions 922, 932 of a fixing rod 92 and a fixing groove 93 shown in FIGS. 21 and 22 can be annular or strip elastic material such as rubber or plastic. Alternatively, the upper contact portions 923, 933 and the lower contact portions 924, 934, as shown in FIGS. 23 and 24 are elastic material covered with annular or strip contact parts 925, 926, 935 and 936 which are made of a hard material. The hard material can be plastic or metal.

Figure 25B:
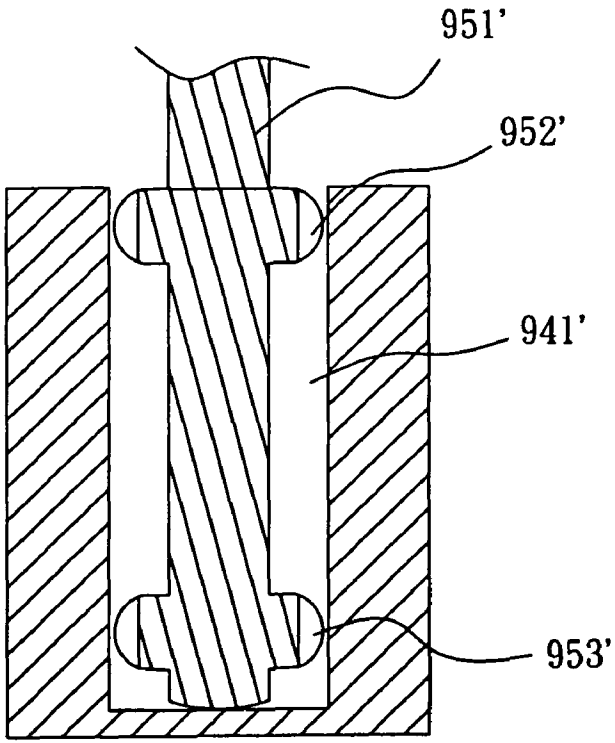
FIG. 25B is a sectional view showing the second embodiment of a fixing groove engaging with a fixing rod according to the present invention.
Figure 25A:
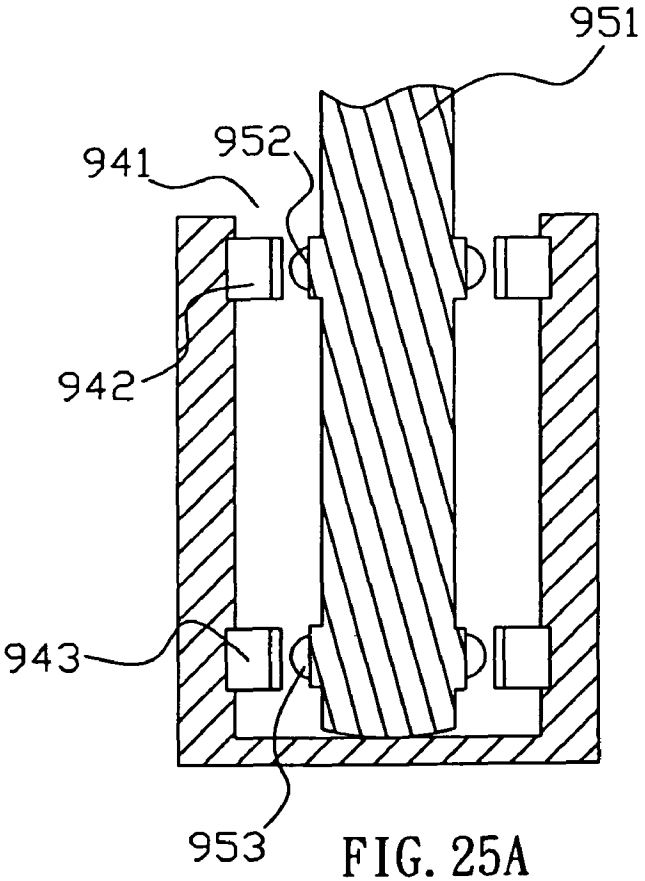
FIG. 25A is a sectional view showing the first embodiment of a fixing groove engaging with a fixing rod according to the present invention.
Figure 25C:
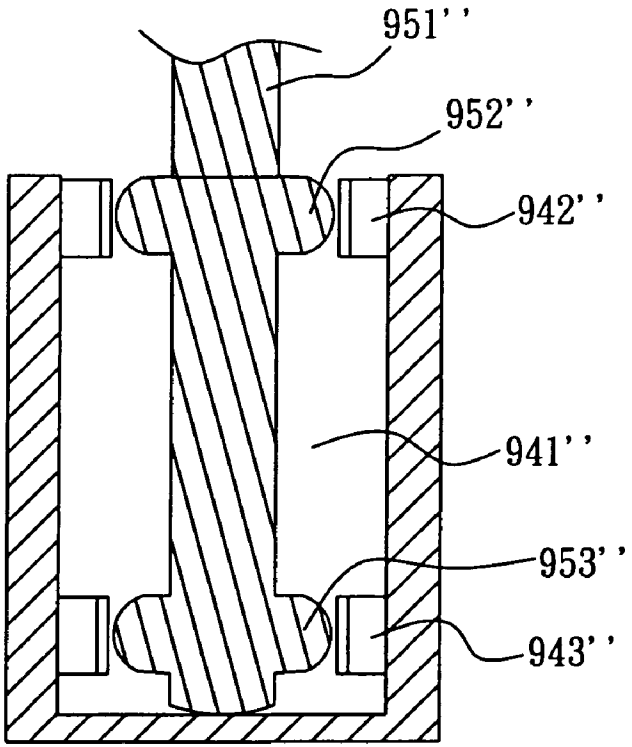
FIG. 25C is a sectional view showing the third embodiment of a fixing groove engaging with a fixing rod according to the present invention.

Please refer to FIGS. 25A, 25B and 25C. The upper contact portions 942, 952 and the lower contact portions 943, 953 shown in FIG. 25A are respectively disposed in a fixing groove 941, and a fixing rod 951 and all the contact portions shown in FIG. 25A can also have a harder contact part respectively. Or, no contact portions are disposed in a fixing groove 941', and the upper and lower contact portions 952' and 953' shown in FIG. 25B are disposed on a fixing rod 951' with a harder contact part covering the contact portions respectively. Or, harder upper and lower contact portions 942" and 943" are disposed on a fixing groove 941", and projecting upper and lower contact portions 952" and 953" are disposed on a fixing rod 951" as shown in FIG. 25C.

Figure 26:
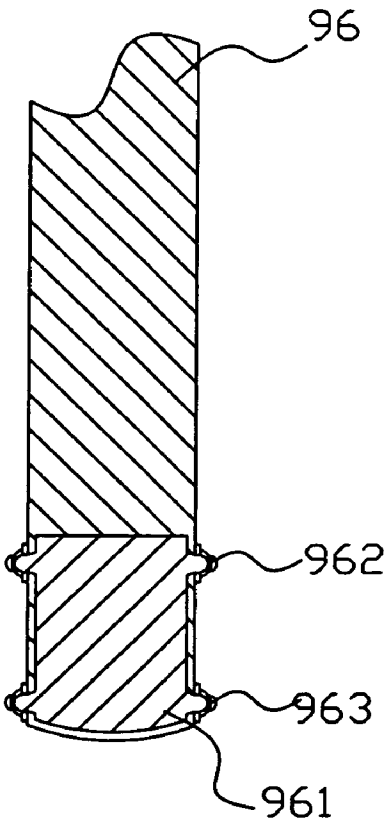
FIG. 26 is a sectional view showing the third embodiment of a fixing rod according to the present invention.

Please refer to FIG. 26. If the main body oscillates up and down strongly, a fluid-storage tank 961 can be disposed in a metal fixing rod 96; the fluid-storage tank 961 is filled up with oil and the oil contacts with the inner sides of upper and lower contact portions 962 and 963. When the upper contact portion 962 or the lower contact portion 963 retracts inward owing to the oscillation of the main body, the oil in the fluid-storage tank 961 is compressed to cause the lower contact portion or the upper contact portion which does not contact with the oil to project outward. Thus, the upper and the lower contact portions 962 and 963 can still naturally contact with a framework as the main body of the holder oscillates up and down.

Figure 27:
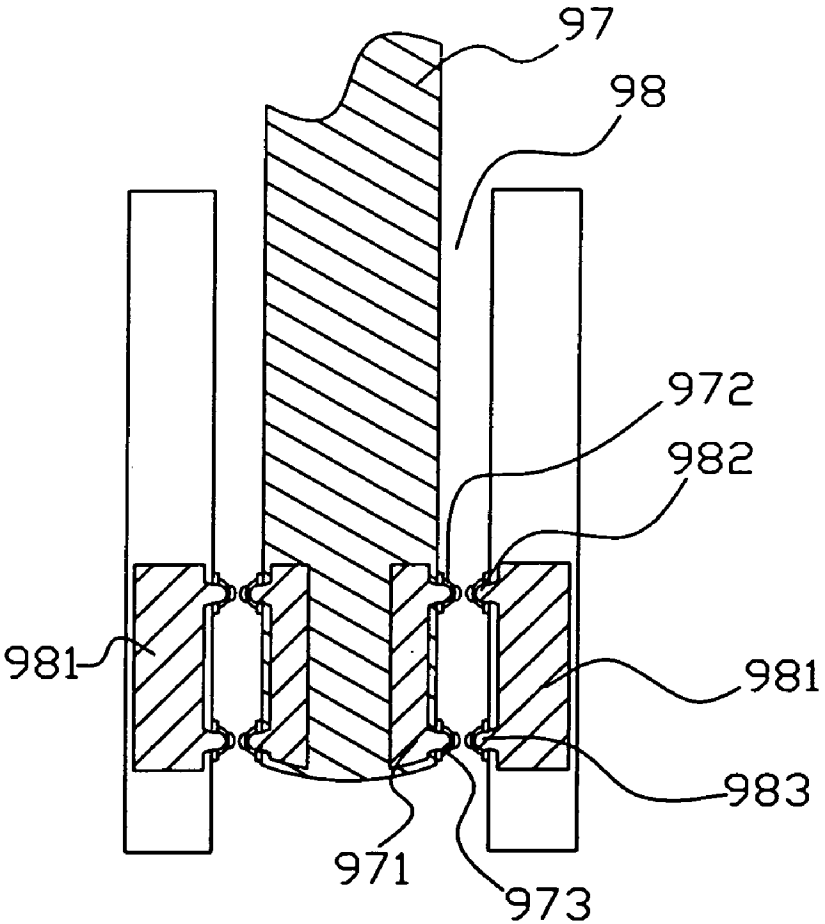
FIG. 27 is a sectional view showing the fourth embodiment of a fixing groove engaging with a fixing rod according to the present invention.

Please refer to FIGS. 26 and 27. Another preferred embodiment of the fixing rod is illustrated. The fixing rod 97 shown in FIG. 27 is almost the same as the fixing rod 96 shown in FIG. 26 in structure. The only difference is in that the fluid-storage tank 971 shown in FIG. 27 is annular instead. Besides, the inner wall of a fixing groove 98 shown in FIG. 27 can be provided with an annular fluid-storage tank 981. The oil in the fluid-storage tank 981 is allowed to contact with the upper and lower contact portions 982 and 983. When the main body oscillates up and down to move the upper and lower contact portions 982, 983 or the fixing rod 97 to tilt toward one side, one of the upper and lower contact portions 972, 973 thrusts the upper contact portion 982 and the lower contact portion 983 such that one of the contact portions 982, 983 retracts inward and the other one of the contact portions 982, 983 projects outward for the fixing rod 97 and the fixing groove 98 maintaining a natural contact with each other in the process of polishing and attaining great polishing effect. The upper contact portions 972, 982 and the lower contact portions 973, 983 of this embodiment can be harder contact portions.

Figure 30:
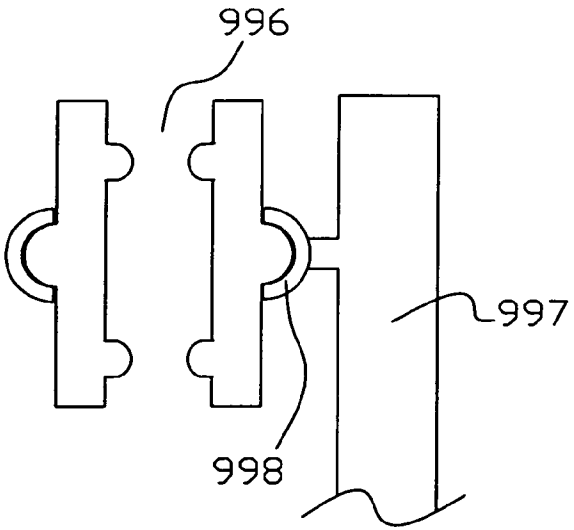
FIG. 30 is a sectional view showing the third embodiment of a fixing groove according to the present invention.
Figure 29:
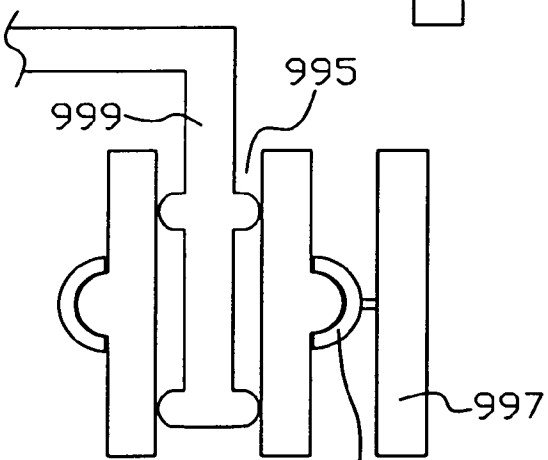
FIG. 29 is a sectional view showing the sixth embodiment of a fixing groove engaging with a fixing rod according to the present invention.
Figure 28:
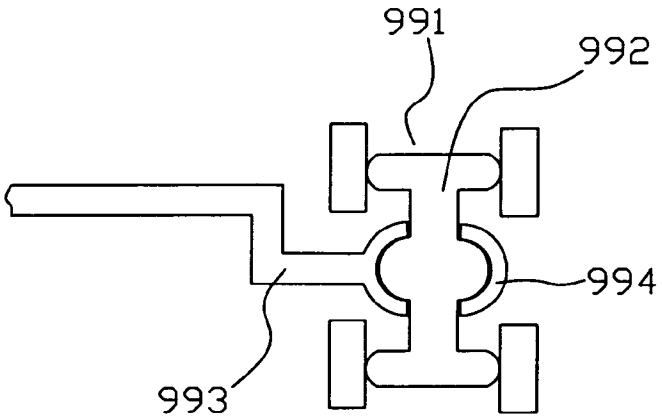
FIG. 28 is a sectional view showing the fifth embodiment of a fixing groove engaging with a fixing rod according to the present invention.

Please refer to FIGS. 28, 29 and 30. If the magnitude of the relative oscillation between a fixing rod 992 which is placed in a fixing groove 991 and the fixing groove 991 is much greater in the process of polishing, a pivoting portion 999 on one end of a support bracket is provided to pivotally connect with the outer wall of the fixing rod 992 for an allowance being obtained such that it is possible for the fixing rod 992 moving relatively with respect to the fixing groove 991; the fixing groove 991 is provided with a hole for being passed through with the support bracket 993 shown in FIG. 28. Alternatively, the outer walls of the fixing grooves 995 and 996 are pivotally connected to a pivoting portion 998 of a support bracket 667 shown in FIGS. 29 and 30 respectively. The pivoting portions 994 and 998 are respectively positioned between the upper and the lower contact portions of the fixing rods 991 and 999 or the fixing grooves 995 and 996. The pivoting portions 994 and 992 can be a ball bearing respectively.

It is appreciated that the holder of the present invention is able to keep parallel to the polishing surface, and maintain a natural contact with the framework. It is incapable of being reached with the prior art. A pressing force through the natural contact between the end surface of the respective optical fiber and the polishing surface can be obtained, and the pressure acting on the end surface of each optical fiber is uniform. Therefore, a great number of the end surfaces of the optical fibers can be polished simultaneously so as to promote the polishing speed and quality.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A holder for supporting end surfaces of workpieces during polishing comprising:

a main body being provided with a plurality of fixtures to hold said workpieces, and being provided with a first fixing portion;

a framework being provided with a second fixing portion corresponding to the first fixing portion;

a polishing surface being disposed under the workpieces for a contact plane is capable of being formed between the polishing surface and the end surfaces;

wherein at least one set of first upper and lower contact portions is provided by either said first fixing portion or said second fixing portion, said first upper and lower contact portions are respectively disposed above and below said contact plane;

whereby, when said first upper and lower contact portions, and said first or second fixing portion contact with one another, said main body is capable of keeping parallel to said polishing surface.

2. The holder according to claim 1, wherein said first fixing portion comprises at least one fixing groove; said second fixing portion comprises at least one fixing rod received in said fixing groove; said first upper and lower contact portions are disposed on and project outward from said fixing rod.

3. The holder according to claim 1, wherein said first fixing portion comprises at least one fixing groove, and said first upper and lower contact portions are disposed on an inner wall of said fixing groove and project toward the fixing groove; said second fixing portion comprises at least one fixing rod, and said fixing rods are accepted in said fixing groove.

4. The holder according to claim 1, wherein said first upper and lower contact portions are annular, and said first or second fixing portion comprises a fixing rod engaged with said upper and said lower contact portions.

5. The holder according to claim 2, wherein said first upper and lower contact portions are elastic materials attached to a periphery of said fixing rod.

6. The holder according to claim 2, wherein said fixing groove is disposed at a center of said main body; a plurality of symmetrical accepting grooves are respectively disposed in the main body close to a periphery of said main body for accepting counterweights, and said counterweights exert a downward force to said main body respectively.

7. The holder according to claim 2, wherein said fixing groove is disposed at a center of said main body, and said fixing rod exerts a downward force to said main body.

8. The holder according to claim 1, wherein said second fixing portion comprises a plurality of symmetrical fixing grooves; a plurality of symmetrical fixing rods are disposed at a periphery of said main body and received in said fixing grooves respectively; said first upper and lower contact portions are disposed on and project outward from said fixing rods respectively; a plurality of symmetrical accepting grooves are respectively disposed in said main body close to a periphery of said main body for accepting counterweights, and said counterweights exert a downward force to said main body respectively.

9. The holder according to claim 2, wherein a plurality of symmetrical fixing grooves are disposed at a periphery of said main body, and said fixing rods exert a downward force to said main body respectively.

10. The holder according to claim 2, wherein a set of second upper and lower contact portions is provided at an inner wall of said fixing groove to project toward said fixing groove for contacting with said first upper and lower contact portions respectively.

11. The holder according to claim 3, wherein said first upper lower contact portions are elastic materials attached to an inner wall of said fixing groove.

12. The holder according to claim 3, wherein said fixing groove is disposed at a center of said main body; a plurality of symmetrical accepting grooves are respectively disposed in the main body close to a periphery of said main body for accepting counterweights, and said counterweights exert a downward force to said main body.

13. The holder according to claim 3, wherein said fixing groove is disposed at a center of said main body, and said fixing rods exert a downward force to said main body respectively.

14. The holder according to claim 1, wherein said second fixing portion comprises a plurality of symmetrical fixing grooves, and said first upper and lower contact portions are disposed on inner walls of said fixing grooves and project toward the fixing grooves respectively; a plurality of symmetrical fixing rods are disposed at a periphery of said main body and accepted in said fixing grooves respectively; a plurality of symmetrical accepting grooves are respectively disposed in said main body close to a periphery of said main body for accepting counterweights, and said counterweights exert a downward force to said main body.

15. The holder according to claim 3, wherein a plurality of symmetrical fixing grooves are disposed at a periphery of said main body, said fixing rods exert downward force to said main body respectively.

16. The holder according to claim 5, wherein said first upper and lower contact portions are provided with a contact part made of hard material at the outer edges thereof.

17. The holder according to claim 8, wherein said framework has a side indenting downward, said fixing grooves are positioned at said side, and bottoms of said fixing grooves are provided with a liquid discharge hole respectively.

18. The holder according to claim 11, wherein outer edges said first upper and lower contact portions respectively have a contact part made of hard material.

19. The holder according to claim 16, wherein a fluid-storage tank is disposed in said fixing rod; said fluid-storage tank is filled up with oil, and said oil contacts with inner sides of said first upper and lower contact portions.

20. The holder according to claim 18, wherein a fluid-storage tank is disposed in an inner wall of said fixing groove; said fluid-storage tank is filled up with oil, and said oil contacts with inner sides of said first upper contact portion and said lower contact portion.

21. The holder according to claim 19, wherein said fluid-storage tank is annular.

22. The holder according to claim 8 further comprises a support bracket with a pivoting portion, wherein said pivoting portion is pivotally connected to an outer wall of the respective fixing groove.

23. The holder according to claim 8 further comprises a support bracket with a pivoting portion, wherein said pivoting portion is pivotally connected to an outer wall of the respective fixing rod, and the respective fixing groove is provided with a hole for allowing said support bracket to pass through.

24. The holder according to claim 14 further comprises a support bracket with a pivoting portion, wherein said pivoting portion is connected to an outer wall of the respective fixing groove.

25. The holder according to claim 14 further comprises a support bracket with a pivoting portion, wherein said pivoting portion is pivotally connected to an outer wall of said fixing rod the respective fixing groove is provided with a hole for allowing said support bracket to pass through.

26. The holder according to claim 22, wherein said pivoting portion of said support bracket is positioned between said first upper and lower contact portions.

27. The holder according to claim 23, wherein said pivoting portion of said support bracket is positioned between said first upper and lower contact portions.

28. The holder according to claim 24, wherein said pivoting portion of said support bracket is positioned between said first upper and lower contact portions.

29. The holder according to claim 25, wherein said pivoting portion of said support bracket is positioned between said first upper and lower contact portions.

30. The holder according to claim 26, wherein said pivoting portion of said support racket is a ball bearing.

31. The holder according claim 1, wherein said first fixing portion comprises at least one fixing groove, and upper and lower ends of an inner wall of said fixing groove respectively acts as said first upper and lower contact portions; an lower end of said fixing groove is provided with a liquid discharge hole; said second fixing portion comprises at least one fixing rod, and said fixing rod is accepted in said fixing groove; a lower end of said fixing rod extends to a lower side of said first lower contact portion.

32. The holder according to claim 1, wherein said first fixing portion comprises at least one fixing groove; said second fixing portion comprises at least one fixing rod and said fixing rod is accepted in said fixing groove; upper and lower ends of an inner wall of said fixing groove respectively act as said first upper and lower contact portions.

33. The holder according to claim 32, wherein said fixing groove and said fixing rod are respectively disposed on at said main body and said framework.

34. The holder according to claim 1, wherein said first fixing portion comprises at least one fixing rod; said second fixing portion comprises at least one fixing groove, and said fixing rod is accepted in said fixing groove; upper and lower ends of an inner wall of said fixing groove respectively act as said first upper and lower contact portions are respectively disposed at said main body and said framework.

35. The holder according to claim 1, wherein said first fixing portion comprises at least one fixing groove; said second fixing portion comprises at least one fixing rod accepted in said fixing groove; an upper end of an inner wall of said fixing groove acts as said first upper contact portion and said inner wall of said fixing groove has a portion corresponding to a lower end of said fixing rod to act as said first lower contact portion.

36. The holder according to claim 1, wherein said first fixing portion comprises at least one fixing groove; said second fixing portion comprises at least one fixing rod, and said fixing rod accepted in said fixing groove; an inner wall of said fixing groove has a portion corresponding to an upper end of said fixing rod to act as said first upper contact portion, and a lower end of said inner wall of said fixing groove acts as said first lower contact portion.

37. The holder according to claim 1, wherein said first fixing portion comprises at least one fixing groove; said second fixing portion comprises at least one fixing rod accepted in said fixing groove; a projection section is provided at an outer wall of said fixing rod; upper and lower ends of said projection section respectively act as said first upper and lower contact portions.

38. The holder according to claim 1, wherein said first fixing portion comprises at least one fixing rod; said second fixing portion comprises at least one fixing groove; said fixing rod is accepted in said fixing groove; a projection section is provided at an outer wall of said fixing rod; upper and lower ends of said projection section respectively act as said first upper contact portion and said lower contact portions.

* * * * *